US011578603B2

(12) United States Patent
Fukui et al.

(10) Patent No.: US 11,578,603 B2
(45) Date of Patent: Feb. 14, 2023

(54) TURBINE BLADE, TURBINE, AND METHOD OF TUNING NATURAL FREQUENCY OF TURBINE BLADE

(71) Applicant: MITSUBISHI HITACHI POWER SYSTEMS, LTD., Yokohama (JP)

(72) Inventors: Yoshio Fukui, Yokohama (JP); Masamitsu Kuwabara, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 266 days.

(21) Appl. No.: 16/978,082

(22) PCT Filed: Mar. 22, 2019

(86) PCT No.: PCT/JP2019/012080
§ 371 (c)(1),
(2) Date: Sep. 3, 2020

(87) PCT Pub. No.: WO2019/188780
PCT Pub. Date: Oct. 3, 2019

(65) Prior Publication Data

US 2021/0095567 A1 Apr. 1, 2021

(30) Foreign Application Priority Data

Mar. 27, 2018 (JP) ..... JP2018-060930

(51) Int. Cl.
*F01D 5/16* (2006.01)
*F01D 5/10* (2006.01)
*F01D 25/06* (2006.01)

(52) U.S. Cl.
CPC ..... *F01D 5/16* (2013.01); *F01D 5/10* (2013.01); *F01D 25/06* (2013.01);
(Continued)

(58) Field of Classification Search
CPC . F01D 25/04; F01D 25/06; F01D 5/10; F01D 5/26; F01D 5/16; F05D 2240/301;
(Continued)

(56) References Cited

U.S. PATENT DOCUMENTS 5,435,694 A * 7/1995 Kray ..... F01D 5/3007 416/239
7,252,481 B2 * 8/2007 Stone ..... F01D 5/3007 416/500
(Continued)

FOREIGN PATENT DOCUMENTS

JP 63-97803 4/1988
JP 2000-248901 9/2000
(Continued)

OTHER PUBLICATIONS

International Search Report dated Jun. 11, 2019 in corresponding International (PCT) Patent Application No. PCT/JP2019/012080.
(Continued)

*Primary Examiner* — Igor Kershteyn
(74) *Attorney, Agent, or Firm* — Wenderoth, Lind & Ponack, L.L.P.

(57) ABSTRACT

A turbine blade includes: a platform; an airfoil portion extending from the platform in a blade height direction and having a pressure surface and a suction surface extending between a leading edge and a trailing edge; a blade root portion positioned opposite to the airfoil portion across the platform in the blade height direction and having a bearing surface; and a shank positioned between the platform and the blade root portion. The shank has a cross-section which is perpendicular to the blade height direction of the airfoil portion, and in which a line segment connecting a widthwise center position of a leading-edge-side end portion of the shank and a widthwise center position of a trailing-edge-side end portion of the shank is sloped to a center line between
(Continued)

a pressure-surface-side contour of the blade root portion and a suction-surface-side contour of the blade root portion.

13 Claims, 10 Drawing Sheets

(52) U.S. Cl.
CPC ..... *F05D 2220/30* (2013.01); *F05D 2230/00* (2013.01); *F05D 2260/96* (2013.01)

(58) Field of Classification Search
CPC ..... F05D 2240/80; F05D 2240/90; F05D 2260/96
See application file for complete search history.

(56) References Cited

U.S. PATENT DOCUMENTS

| | | | | |
|---|---|---|---|---|
| 7,467,924 | B2 * | 12/2008 | Charbonneau | F01D 5/3007 416/193 A |
| 7,481,614 | B2 * | 1/2009 | Tomita | F01D 5/22 416/243 |
| 8,007,245 | B2 * | 8/2011 | Brittingham | F01D 5/3007 416/243 |
| 8,435,008 | B2 * | 5/2013 | Hagan | F01D 5/3007 416/239 |
| 9,316,105 | B2 * | 4/2016 | Khanin | F01D 5/3007 |
| 10,677,073 | B2 * | 6/2020 | Thistle | F01D 5/26 |
| 10,724,536 | B2 * | 7/2020 | Kalochairetis | F04D 29/668 |
| 2002/0081206 | A1 | 6/2002 | Wang et al. | |
| 2003/0040262 | A1 | 2/2003 | Devine, II | |
| 2005/0186074 | A1 | 8/2005 | Tomita et al. | |
| 2005/0254958 | A1 | 11/2005 | Stone | |
| 2007/0031259 | A1 | 2/2007 | Dube et al. | |
| 2010/0098547 | A1 | 4/2010 | Hagan et al. | |
| 2012/0051930 | A1 | 3/2012 | Pandey et al. | |
| 2013/0011264 | A1 | 1/2013 | Khanin et al. | |
| 2013/0224036 | A1 | 8/2013 | Lamicq et al. | |
| 2014/0112786 | A1 * | 4/2014 | Donnell | F01D 11/006 416/140 |

FOREIGN PATENT DOCUMENTS

| | | |
|---|---|---|
| JP | 2002-201904 | 7/2002 |
| JP | 2003-106167 | 4/2003 |
| JP | 2005-233141 | 9/2005 |
| JP | 2007-40296 | 2/2007 |
| JP | 2007-537385 | 12/2007 |
| JP | 2012-52526 | 3/2012 |

OTHER PUBLICATIONS

International Preliminary Report on Patentability dated Oct. 8, 2020 in corresponding International (PCT) Patent Application No. PCT/JP2019/012080, with English Translation.

* cited by examiner

TURBINE BLADE, TURBINE, AND METHOD OF TUNING NATURAL FREQUENCY OF TURBINE BLADE

TECHNICAL FIELD

The present disclosure relates to a turbine blade, a turbine, and a method of tuning the natural frequency of a turbine blade.

BACKGROUND

A blade of a turbine such as a gas turbine or a steam turbine receives excitation force generated by change and rotation of combustion gas flow or steam flow during operation of the turbine. The resonance phenomenon caused by such an excitation force may cause damage to the turbine blade, rotor disc, or the like.

Therefore, it has been proposed to tune the natural frequency of the turbine blade in order to avoid the occurrence of resonance in the turbine blade.

For example, Patent Document 1 discloses a turbine blade (hollow blade) composed of a material having a multilayer structure including a core material and a skin material disposed on both sides of the core material. The core material of the turbine blade has multiple dimples to improve the stiffness of the turbine blade. The stiffness distribution of the turbine blade is adjusted by varying the dimple density in the core material, and the natural frequency of the turbine blade is adjusted accordingly.

CITATION LIST

Patent Literature

Patent Document 1: JP2000-248901A

SUMMARY

Problems to be Solved

The turbine blade has several vibration modes, and the resonance frequency varies with individual vibration modes.

It is thus desirable to remove the resonance frequency of a specific vibration mode and selectively adjust the natural frequency at which the resonance phenomenon does not occur in the turbine blade.

In view of the above, an object of at least one embodiment of the present invention is to provide a turbine blade, a turbine including the same, and a method of tuning the natural frequency of the turbine blade whereby it is possible to remove the resonance frequency of a specific vibration mode and selectively adjust the natural frequency.

Solution to the Problems (1) A turbine blade according to at least one embodiment of the present invention comprises: a platform; an airfoil portion extending from the platform in a blade height direction and having a pressure surface and a suction surface extending between a leading edge and a trailing edge; a blade root portion positioned opposite to the airfoil portion across the platform in the blade height direction and having a bearing surface; and a shank positioned between the platform and the blade root portion, wherein the shank has a cross-section which is perpendicular to the blade height direction of the airfoil portion, and in which a line segment connecting a widthwise center position of a leading-edge-side end portion of the shank and a widthwise center position of a trailing-edge-side end portion of the shank is sloped to a center line between a pressure-surface-side contour of the blade root portion and a suction-surface-side contour of the blade root portion.

With the above configuration (1), at any position in the blade height direction, the shank has a cross-section perpendicular to the blade height direction in which the line segment connecting the widthwise center position of the leading-edge-side end portion of the shank and the widthwise center position of the trailing-edge-side end portion of the shank is sloped to the center line between the pressure-surface-side contour of the blade root portion and the suction-surface-side contour of the blade root portion (hereinafter, also referred to as "central axis of blade root portion"). In this cross-section, the shank has a shape protruding or recessed in the width direction at at least one of pair of diagonal positions. Thus, the stiffness of the shank is increased or decreased at this position, compared with the case where the line segment is parallel to the center line of the blade root portion. Accordingly, it is possible to selectively increase or decrease the natural frequency of a vibration mode in which a relatively large stress occurs at the pair of diagonal positions. In this way, it is possible to selectively adjust the natural frequency of a specific vibration mode while suppressing the influence on the natural frequency of other vibration modes. Thus, it is possible to reduce damage due to vibration of the turbine blade.

(2) In some embodiments, in the above configuration (1), the shank has the cross-section satisfying at least one of the following conditions: (a) the shank has a first contour on a pressure surface side, and a trailing-edge-side region of the first contour has a first protruding portion protruding outward to the pressure surface side compared with a leading-edge-side region of the first contour; or (b) the shank has a second contour on a suction surface side, and a leading-edge-side region of the second contour has a second protruding portion protruding outward to the suction surface side compared with a trailing-edge-side region of the second contour.

With the above configuration (2), since the shank has a protruding portion (first protruding portion or second protruding portion) at at least one of pair of diagonal positions (regions) including the trailing-edge-side region on the pressure surface side and the leading-edge-side region on the suction surface side in the cross-section at any position in the blade height direction, it is possible to improve the stiffness at the position provided with the protruding portion. As a result, it is possible to selectively adjust the natural frequency of a vibration mode in which the airfoil portion vibrates along the center line (i.e., vibration mode in which a relatively large stress occurs at the pair of diagonal positions).

(3) In some embodiments, in the above configuration (2), the first contour of the shank on the pressure surface side includes: a first leading-edge-side contour positioned on a leading edge side; a first trailing-edge-side contour positioned on a trailing edge side; and a first middle contour positioned between the first leading-edge-side contour and the first trailing-edge-side contour. The second contour of the shank on the suction surface side includes: a second leading-edge-side contour positioned on a leading edge side; a second trailing-edge-side contour positioned on a trailing edge side; and a second middle contour positioned between the second leading-edge-side contour and the second trailing-edge-side contour. At least one of the first protruding portion or the second protruding portion extends, in a height direction of the shank, over a range in the blade height direction including a blade-height-directional position at which a distance between the first middle contour and the second middle contour is smallest and including both sides of the blade-height-directional position.

With the above configuration (3), the shank has the cross-section described in the above (2) within the range in the blade height direction including the position at which the distance between the first middle contour on the pressure surface side and the second middle contour on the suction surface side (shank thickness) is smallest. That is, since the shank has a protruding portion (first protruding portion or second protruding portion) at at least one of pair of diagonal positions (regions) including the trailing-edge-side region on the pressure surface side and the leading-edge-side region on the suction surface side in this cross-section, it is possible to improve the stiffness at the position provided with the protruding portion, and selectively adjust the natural frequency of a vibration mode in which the airfoil portion vibrates along the center line. Consequently, it is possible to more effectively reduce damage to the turbine blade.

(4) In some embodiments, in the above configuration (3), at least one of the first protruding portion or the second protruding portion extends, in the blade height direction of the shank, over an entire range between a lower surface of the platform and an upper end of the bearing surface.

With the above configuration (4), since at least one of the first protruding portion or the second protruding portion is provided so as to extend over the entire range between the lower surface of the platform and the upper end of the bearing surface in the height direction of the shank, it is possible to reliably increase the stiffness at the position of the first protruding portion or the second protruding portion. Thus, it is possible to more effectively adjust the natural frequency of a vibration mode in which the airfoil portion vibrates along the center line.

(5) In some embodiments, in any one of the above configurations (2) to (4), at least one of the first protruding portion or the second protruding portion extends linearly and parallel to the center line in the cross-section.

With the above configuration (5) since at least one of the first protruding portion or the second protruding portion is formed so as to extend linearly and parallel to the center line in the cross-section, the above configuration (2) can be achieved without significantly changing the shape of the shank portion, compared with the case where such a protruding portion is not provided.

(6) In some embodiments, in the above configuration (1), the shank has the cross-section satisfying at least one of the following conditions: (c) the shank has a first contour on a pressure surface side, and a trailing-edge-side region of the first contour has a first recess portion recessed inward from the pressure surface side compared with a leading-edge-side region of the first contour; or (d) the shank has a second contour on a suction surface side, and a leading-edge-side region of the second contour has a second recess portion recessed inward from the suction surface side compared with a trailing-edge-side region of the second contour.

With the above configuration (6), since the shank has a recess portion (first recess portion or second recess portion) at at least one of pair of diagonal positions (regions) including the trailing-edge-side region on the pressure surface side and the leading-edge-side region on the suction surface side in the cross-section at any position in the blade height direction, it is possible to decrease the stiffness at the position provided with the recess portion. Thus, it is possible to selectively adjust the natural frequency of a vibration mode in which the airfoil portion vibrates along the center line.

(7) In some embodiments, in any one of the above configurations (1) to (6), the shank is configured such that, in the cross-section, a first contour of the shank on a pressure surface side includes a first linear portion extending linearly and parallel to the center line of the blade root portion in a region except a trailing-edge-side region, and a second contour of the shank on a suction surface side includes a second linear portion extending linearly and parallel to the center line of the blade root portion in a region except a leading-edge-side region.

With the above configuration (7), the shank has the following cross-section (first cross-section) at any height position. Specifically, in this cross-section (first cross-section), the shank has a protruding portion (e.g., first protruding portion or second protruding portion described above) or a recess portion (e.g., first recess portion or second recess portion described above) with reference to the first linear portion or the second linear portion parallel to the center line, at the pair of diagonal positions that can adjust the natural frequency of a vibration mode in which the airfoil portion vibrates along the center line. Thus, it is possible to selectively adjust the natural frequency of a vibration mode in which the airfoil portion vibrates along the center line.

(8) In some embodiments, in any one of the above configurations (1) to (5), a first contour of the shank on a pressure surface side includes: a first leading-edge-side contour positioned on a leading edge side; a first trailing-edge-side contour positioned on a trailing edge side; and a first middle contour positioned between the first leading-edge-side contour and the first trailing-edge-side contour. A second contour of the shank on a suction surface side includes: a second leading-edge-side contour positioned on a leading edge side; a second trailing-edge-side contour positioned on a trailing edge side; and a second middle contour positioned between the second leading-edge-side contour and the second trailing-edge-side contour. The shaft has the cross-section satisfying at least one of the following conditions: (e) a distance from a reference line passing through a midpoint of the line segment and parallel to the center line of the blade root portion increases in order of the first middle contour, the first leading-edge-side contour, and the first trailing-edge-side contour; or (f) a distance from the reference line increases in order of the second middle contour, the second trailing-edge-side contour, and the second leading-edge-side contour.

With the above configuration (8), the shank has the following cross-section (second cross-section) at any height position. Specifically, in this cross-section (second cross-section), the first contour on the pressure surface side protrudes on the trailing edge side than on the leading edge side, or the second contour on the suction surface side protrudes on the leading edge side than on the trailing edge side. Thus, with the protrusions provided at the pair of diagonal positions that can adjust the natural frequency of a vibration mode in which the airfoil portion vibrates along the center line, it is possible to improve the stiffness at the diagonal position, and selectively adjust the natural frequency of the turbine blade.

(9) In some embodiments, in the above configuration (8), the shank has the cross section satisfying at least one of the condition (e) or (f) at a position, in a height direction of the shank, at which a distance between the first middle contour and the second middle contour is smallest.

With the above configuration (9), since the shank has the cross-section (second cross-section) described in the above (8) at the height position at which the shank has the smallest thickness, as described in the above (8), it is possible to improve the stiffness at the diagonal positions with the protrusions. Thus, it is possible to adjust the natural frequency of a vibration mode in which the airfoil portion vibrates along the center line.

(10) In some embodiments, in the above configuration (1) or (6), a first contour of the shank on a pressure surface side includes: a first leading-edge-side contour positioned on a leading edge side; a first trailing-edge-side contour positioned on a trailing edge side; and a first middle contour positioned between the first leading-edge-side contour and the first trailing-edge-side contour. A second contour of the shank on a suction surface side includes: a second leading-edge-side contour positioned on a leading edge side; a second trailing-edge-side contour positioned on a trailing edge side; and a second middle contour positioned between the second leading-edge-side contour and the second trailing-edge-side contour. The shaft has the cross-section satisfying at least one of the following conditions: (g) a distance from a reference line passing through a midpoint of the line segment and parallel to the center line of the blade root portion increases in order of the first middle contour, the first trailing-edge-side contour, and the first leading-edge-side contour; or (h) a distance from the reference line increases in order of the second middle contour, the second leading-edge-side contour, and the second trailing-edge-side contour.

With the above configuration (10), the shank has the following cross-section (third cross-section) at any height position. Specifically, in this cross-section (third cross-section), the first contour on the pressure surface side is recessed on the trailing edge side than on the leading edge side, or the second contour on the suction surface side is recessed on the leading edge side than on the trailing edge side. Thus, with the recesses provided at the pair of diagonal positions that can adjust the natural frequency of a vibration mode in which the airfoil portion vibrates along the center line, it is possible to decrease the stiffness at the diagonal position, and selectively adjust the natural frequency of the turbine blade.

(11) In some embodiments, in the above configuration (10), the shank has the cross-section satisfying at least one of the condition (g) or (h) at a position, in a height direction of the shank, at which a distance between the first middle contour and the second middle contour is smallest.

With the above configuration (11), since the shank has the cross-section (third cross-section) described in the above (10) at the height position at which the shank has the smallest thickness, as described in the above (10), it is possible to decrease the stiffness at the diagonal positions with the recesses. Thus, it is possible to adjust the natural frequency of a vibration mode in which the airfoil portion vibrates along the center line.

(12) A turbine according to at least one embodiment of the present invention comprises: the turbine blade according to any one of the above (1) to (11); and a rotor disc having a blade groove engaged with the blade root portion of the turbine blade.

With the above configuration (12), at any position in the blade height direction, the shank has a cross-section perpendicular to the blade height direction in which the line segment connecting the widthwise center position of the leading-edge-side end portion of the shank and the widthwise center position of the trailing-edge-side end portion of the shank is sloped to the center line between the pressure-surface-side contour of the blade root portion and the suction-surface-side contour of the blade root portion. In this cross-section, the shank has a shape protruding or recessed in the width direction at at least one of pair of diagonal positions. Thus, the stiffness of the shank is increased or decreased at this position, compared with the case where the line segment is parallel to the center line. Accordingly, it is possible to selectively increase or decrease the natural frequency of a vibration mode in which a relatively large stress occurs at the pair of diagonal positions. In this way, it is possible to selectively adjust the natural frequency of a specific vibration mode while suppressing the influence on the natural frequency of other vibration modes. Thus, it is possible to reduce damage due to vibration of the turbine blade.

(13) A method of tuning a natural frequency of a turbine blade according to at least one embodiment of the present invention is to tune a turbine blade including: a platform; an airfoil portion extending from the platform in a blade height direction and having a pressure surface and a suction surface extending between a leading edge and a trailing edge; a blade root portion positioned opposite to the airfoil portion across the platform in the blade height direction and having a bearing surface; and a shank positioned between the platform and the blade root portion, the shank having a cross-section which is perpendicular to the blade height direction of the airfoil portion, and in which a line segment connecting a widthwise center position of a leading-edge-side end portion of the shank and a widthwise center position of a trailing-edge-side end portion of the shank is sloped to a center line between a pressure-surface-side contour of the blade root portion and a suction-surface-side contour of the blade root portion. The method comprises: a step of processing an outer shape of the shank so as to change an angle of the line segment with respect to the center line of the blade root portion.

With the above method (13), the outer shape of the shank is processed so as to change the angle of the line segment perpendicular to the blade height direction and connecting the widthwise center position of the leading-edge-side end portion of the shank and the widthwise center position of the trailing-edge-side end portion of the shank with respect to the center line of the blade root portion, at any position in the blade height direction. Specifically, in this cross-section, the outer shape of the shank is processed by appropriately changing the angle of the line segment with respect to the center line of the blade root portion such that the shank has a shape protruding or recessed in the width direction at at least one of pair of diagonal positions. Thus, the stiffness of the shank is increased or decreased at this position, compared with the case where the line segment is parallel to the center line of the blade root portion. Accordingly, it is possible to selectively increase or decrease the natural frequency of a vibration mode in which a relatively large stress occurs at the pair of diagonal positions. In this way, it is possible to selectively adjust the natural frequency of a specific vibration mode while suppressing the influence on the natural frequency of other vibration modes. Thus, it is possible to reduce damage due to vibration of the turbine blade.

(14) In some embodiments, in the above method (13), a natural frequency in a mode in which the airfoil portion of the turbine blade vibrates along the center line is adjusted by processing the outer shape of the shank.

With the above method (14), the outer shape of the shank is processed so as to protrude or be recessed in the width direction at at least one pair of diagonal positions to adjust the natural frequency of a vibration mode in which the airfoil portion vibrates along the center line. Thus, it is possible to selectively adjust the natural frequency of a vibration mode in which the airfoil portion vibrates along the center line.

(15) In some embodiments, in the above method (13) or (14), in the cross-section, the shank satisfies at least one of the following conditions: (a) the shank has a first contour on a pressure surface side, and a trailing-edge-side region of the first contour has a first protruding portion protruding outward to the pressure surface side compared with a leading-edge-side region of the first contour; or (b) the shank has a second contour on a suction surface side, and a leading-edge-side region of the second contour has a second protruding portion protruding outward to the suction surface side compared with a trailing-edge-side region of the second contour, and the step of processing the outer shape includes adjusting at least one of: a protrusion amount of the first protruding portion in a width direction of the shank or a size of a range of the first contour occupied by the first protruding portion; or a protrusion amount of the second protruding portion in the width direction of the shank or a size of a range of the second contour occupied by the second protruding portion.

With the above method (15), when the shank has a protruding portion (first protruding portion or second protruding portion) at at least one of pair of diagonal positions (regions) including the trailing-edge-side region on the pressure surface side and the leading-edge-side region on the suction surface side in the cross-section at any position in the blade height direction, the protrusion amount of the protruding portion in the width direction or the size of the range occupied by the protruding portion is adjusted by processing. Thus, by processing the shank such that the protrusion amount of the protruding portion or the size of the range occupied by the protruding portion is appropriate, it is possible to improve the stiffness at the position provided with the protruding portion, and adjust the natural frequency into a desired value. Thus, it is possible to selectively adjust the natural frequency of a vibration mode in which the airfoil portion vibrates along the center line.

(16) In some embodiments, in the above method (13) or (14), in the cross-section, the shank satisfies at least one of the following conditions: (c) the shank has a first contour on a pressure surface side, and a trailing-edge-side region of the first contour has a first recess portion recessed inward from the pressure surface side compared with a leading-edge-side region of the first contour; or (d) the shank has a second contour on a suction surface side, and a leading-edge-side region of the second contour has a second recess portion recessed inward from the suction surface side compared with a trailing-edge-side region of the second contour, and the step of processing the outer shape includes adjusting at least one of: a recess amount of the first recess portion in a width direction of the shank or a size of a range of the first contour occupied by the first recess portion; or a recess amount of the second recess portion in the width direction of the shank or a size of a range of the second contour occupied by the second recess portion.

With the above method (16), when the shank has a recess portion (first recess portion or second recess portion) at at least one of pair of diagonal positions (regions) including the trailing-edge-side region on the pressure surface side and the leading-edge-side region on the suction surface side in the cross-section at any position in the blade height direction, the recess amount of the recess portion in the width direction or the size of the range occupied by the recess portion is adjusted by processing. Thus, by processing the shank such that the recess amount of the recess portion or the size of the range occupied by the recess portion is appropriate, it is possible to decrease the stiffness at the position provided with the recess portion, and adjust the natural frequency into a desired value. Thus, it is possible to selectively adjust the natural frequency of a vibration mode in which the airfoil portion vibrates along the center line.

(17) A method of tuning a natural frequency of a turbine blade according to at least one embodiment of the present invention is to tune a turbine blade including a platform; an airfoil portion extending from the platform in a blade height direction and having a pressure surface and a suction surface extending between a leading edge and a trailing edge; a blade root portion positioned opposite to the airfoil portion across the platform and having a bearing surface; and a shank positioned between the platform and the blade root portion. The method comprises: a step of processing an outer shape of the shank in at least one of a trailing-edge-side region of a first contour of the shank on a pressure surface side or a leading-edge-side region of a second contour of the shank on a suction surface side.

With the above method (17), since the outer shape of the shank is processed in at least one of the trailing-edge-side region on the pressure surface side of the shank or the leading-edge-side region on the suction surface side of the shank, the shank is processed into a shape protruding or recessed in the width direction at at least one of pair of diagonal positions. Thus, the stiffness of the shank is increased or decreased at the diagonal position, so that it is possible to selectively increase or decrease the natural frequency of a vibration mode in which a relatively large stress occurs at the pair of diagonal positions. In this way, it is possible to selectively adjust the natural frequency of a specific vibration mode while suppressing the influence on the natural frequency of other vibration modes. Thus, it is possible to reduce damage due to vibration of the turbine blade.

Advantageous Effects

At least one embodiment of the present invention provides a turbine blade, a turbine including the same, and a method of tuning the natural frequency of the turbine blade whereby it is possible to remove the resonance frequency of a specific vibration mode and selectively adjust the natural frequency.

DETAILED DESCRIPTION

Embodiments of the present invention will now be described in detail with reference to the accompanying drawings. It is intended, however, that unless particularly identified, dimensions, materials, shapes, relative positions, and the like of components described in the embodiments shall be interpreted as illustrative only and not intended to limit the scope of the present invention.

Figure 1:
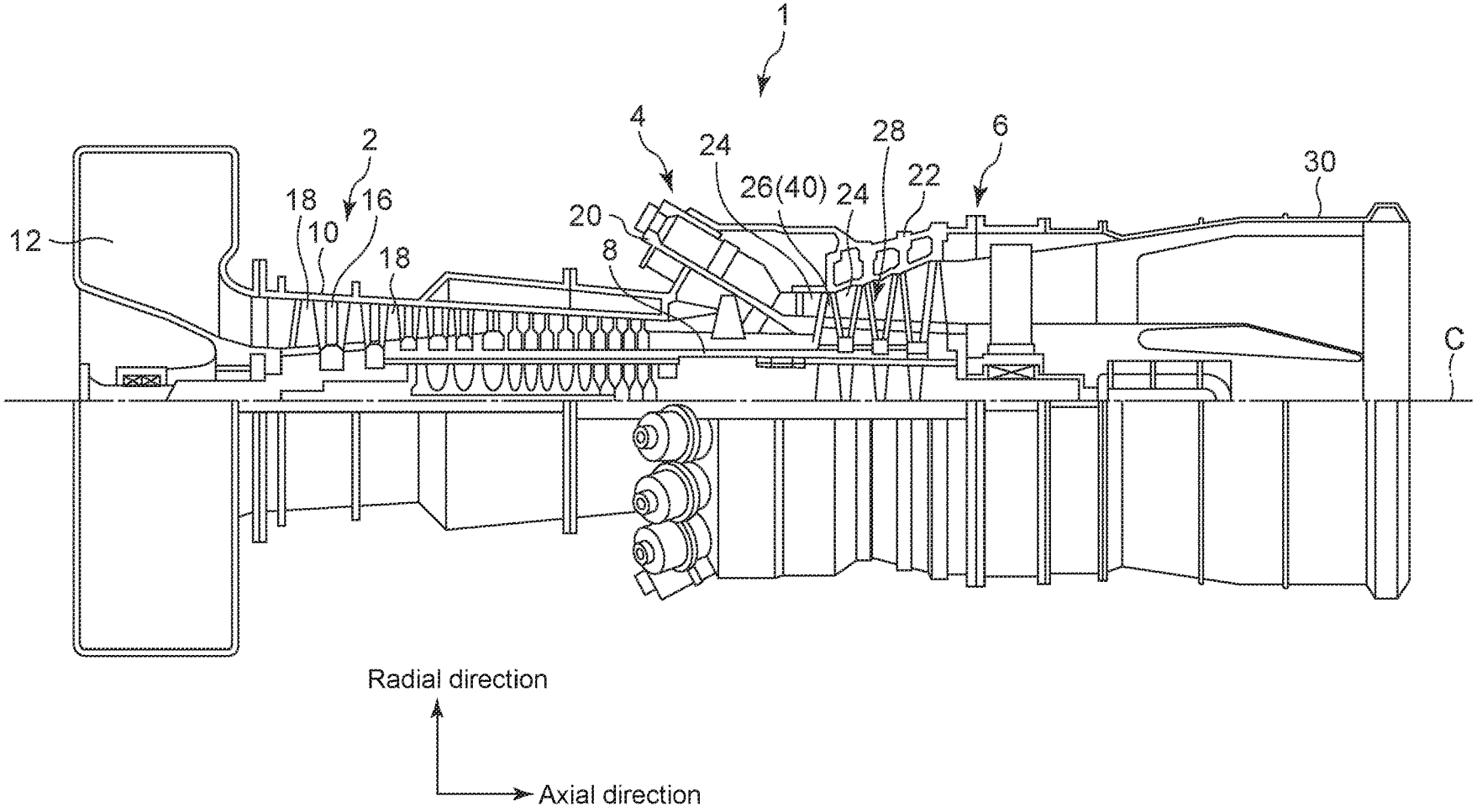
FIG. 1 is a schematic configuration diagram of a gas turbine according to an embodiment.

First, a gas turbine, which is an example of application of a turbine blade according to some embodiments, will be described with reference to FIG. 1. FIG. 1 is a schematic configuration diagram of a gas turbine according to an embodiment.

As shown in FIG. 1, the gas turbine 1 includes a compressor 2 for producing compressed air, a combustor 4 for producing a combustion gas from the compressed air and fuel, and a turbine 6 configured to be rotationally driven by the combustion gas. In the case of the gas turbine 1 for power generation, a generator (not shown) is connected to the turbine 6.

The compressor 2 includes a plurality of stator blades 16 fixed to a compressor casing 10 and a plurality of rotor blades 18 implanted on a rotor 8 so as to be arranged alternately with the stator blades 16.

To the compressor 2, air sucked in from an air inlet 12 is supplied. The air flows through the plurality of stator blades 16 and the plurality of rotor blades 18 to be compressed into compressed air having a high temperature and a high pressure.

The combustor 4 is supplied with fuel and the compressed air produced in the compressor 2. The combustor 4 combusts the fuel to produce a combustion gas that serves as a working fluid of the turbine 6. As shown in FIG. 1, the gas turbine 1 has a plurality of combustors 4 arranged along the circumferential direction around the rotor 8 (rotor axis C) inside a casing 20.

The turbine 6 has a combustion gas passage 28 formed by a turbine casing 22 and includes a plurality of stator blades 24 and a plurality of rotor blades 26 disposed in the combustion gas passage 28.

The stator blades 24 are fixed to the turbine casing 22, and a set of the stator blades 24 arranged along the circumferential direction of the rotor 8 forms a stator blade array. Further, the rotor blades 26 are implanted on the rotor 8, and a set of the rotor blades 26 arranged along the circumferential direction of the rotor 8 forms a rotor blade array. The stator blade arrays and the rotor blade arrays are arranged alternately in the axial direction of the rotor 8.

In the turbine 6, as the combustion gas introduced from the combustor 4 into the combustion gas passage 28 passes through the plurality of stator blades 24 and the plurality of rotor blades 26, the rotor 8 is rotationally driven around the rotor axis C. Thereby, the generator connected to the rotor 8 is driven to generate power. The combustion gas having driven the turbine 6 is discharged outside via an exhaust chamber 30.

Next, a turbine blade according to some embodiments will be described. In the following description, the rotor blade 26 (see FIG. 1) of the turbine 6 of the gas turbine 1 will be described as a turbine blade 40 according to some embodiments, but in other embodiments, the turbine blade may be the stator blade 24 (see FIG. 1) of the turbine 6 of the gas turbine 1, or may be a rotor blade or a stator blade of a steam turbine.

Figure 2:
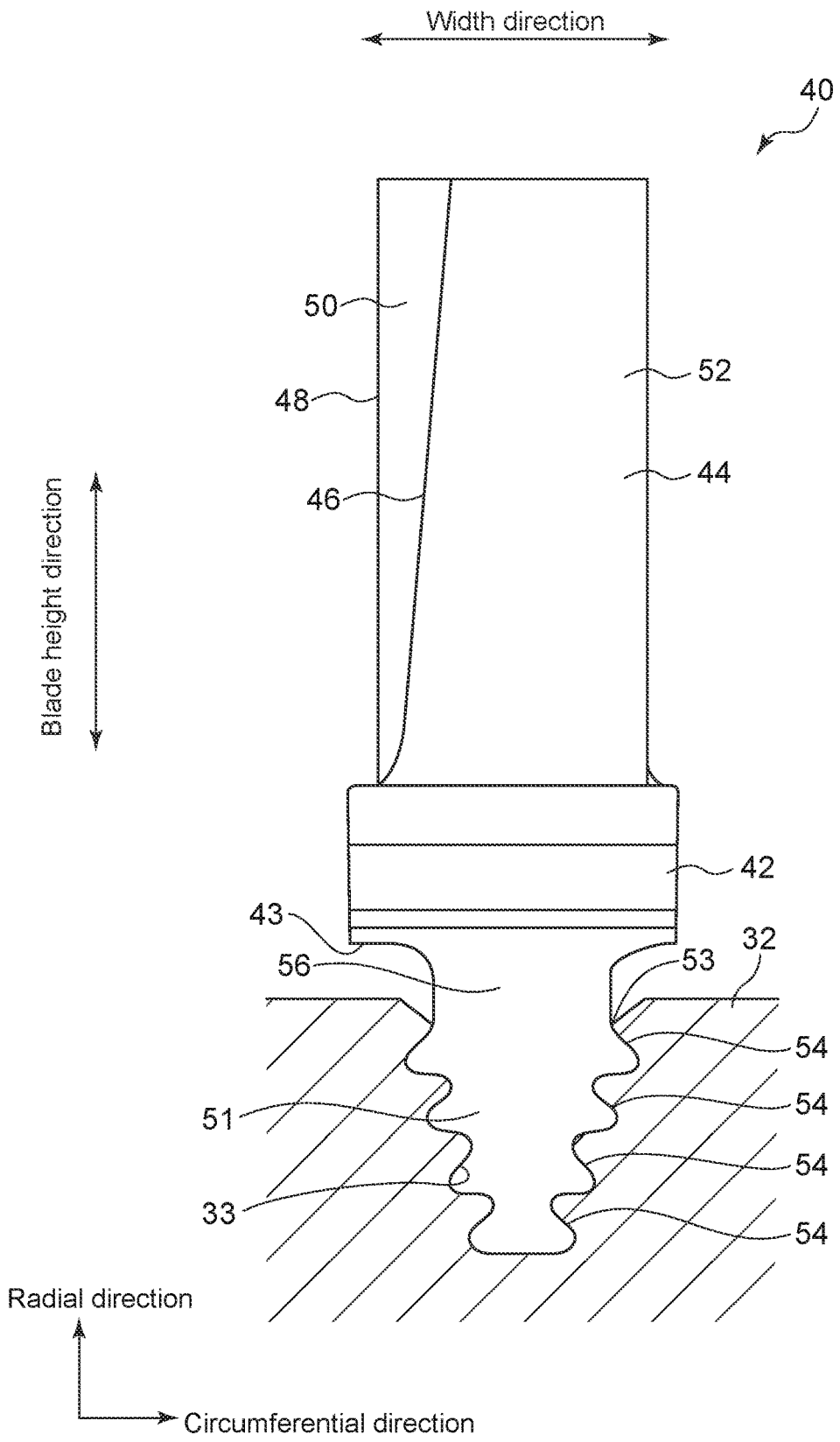
FIG. 2 is a diagram of a turbine blade according to an embodiment, viewed in a direction from the leading edge to the trailing edge.
Figure 3:
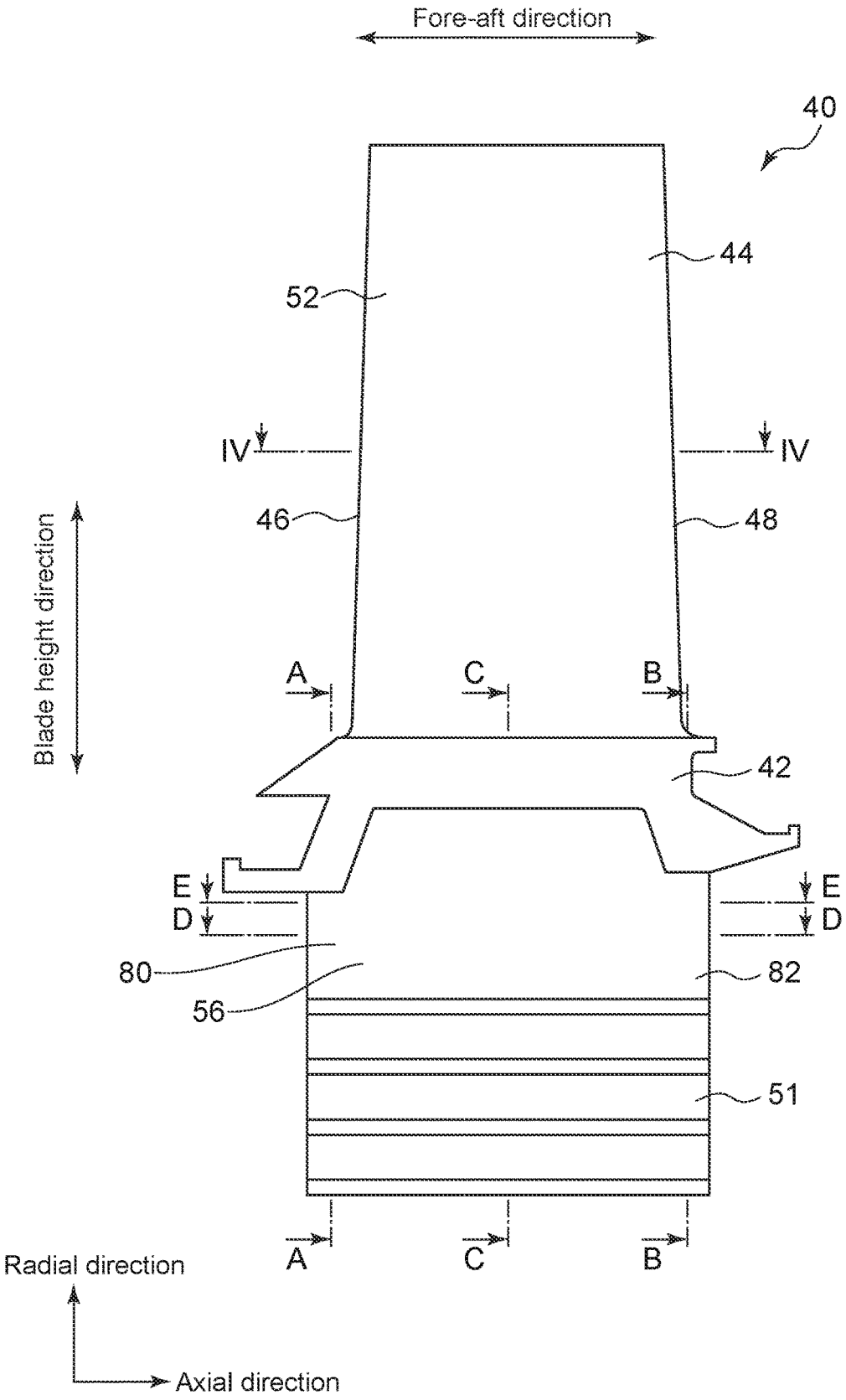
FIG. 3 is a diagram of the turbine blade shown in FIG. 2, viewed in a direction from the suction surface to the pressure surface.
Figure 4:
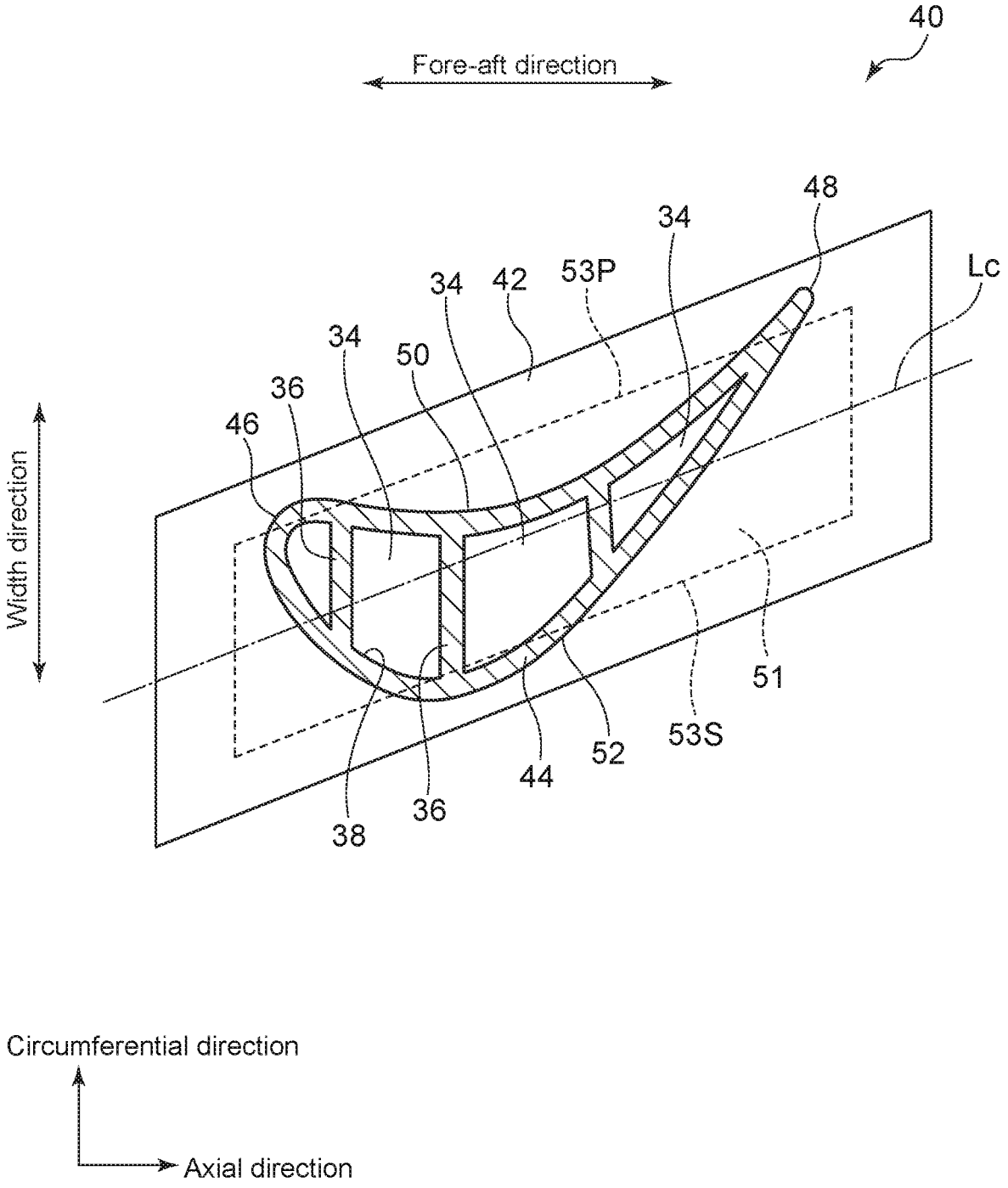
FIG. 4 is a cross-sectional view taken along line IV-IV in FIG. 3.

FIG. 2 is a diagram of the turbine blade 40 according to an embodiment, viewed in a direction from the leading edge to the trailing edge. FIG. 3 is a diagram of the turbine blade 40 shown in FIG. 2, viewed in a direction from the suction surface to the pressure surface. FIG. 4 is a cross-sectional view taken along line IV-IV in FIG. 3. In FIG. 2, the turbine blade 40 is depicted together with a rotor disc 32 of the turbine 6.

As shown in FIGS. 2 to 4, the turbine blade 40 (rotor blade 26) according to an embodiment includes a platform 42, an airfoil portion 44 and a blade root portion 51 positioned opposite to each other across the platform 42 in the blade height direction (also referred to as spanwise direction), and a shank 56 positioned between the platform 42 and the blade root portion 51.

The airfoil portion 44 is disposed so as to extend in the blade height direction with respect to the rotor 8.

The airfoil portion 44 has a leading edge 46 and a trailing edge 48 extending along the blade height direction, and has a pressure surface 50 and a suction surface 52 extending between the leading edge 46 and the trailing edge 48. As shown in FIG. 4, inside the airfoil portion 44, a cooling passage 34 may be formed through which a cooling fluid flows for cooling the airfoil portion 44. In the exemplary embodiment shown in FIG. 4, a rib 36 separating the interior space of the airfoil portion 44 along the blade height direction is provided, and an inner wall surface 38 of the airfoil portion 44 and the rib 36 form a plurality of cooling passages 34.

As shown in FIG. 2, in the turbine 6, the blade root portion 51 is engaged with the blade groove 33 provided in the rotor disc 32 which rotates with the rotor 8. Thus, the turbine blade 40 is implanted on the rotor 8 (see FIG. 1) of the turbine 6 and rotates together with the rotor 8 around the rotor axis C. Further, the blade root portion 51 has a bearing surface 54. The bearing surface 54 is a portion of the surface of the blade root portion 51 which comes into contact with the surface of the blade groove 33 of the rotor disc 32 when the rotor 8 rotates and centrifugal force acts on the turbine blade 40. In other words, the bearing surface 54 is a surface that faces the direction from the blade root portion 51 to the airfoil portion 44 in the blade height direction (i.e., a surface that faces outward in the radial direction of the rotor 8).

As shown in FIG. 4, a pressure-surface-side contour 53P and a suction-surface-side contour 53 S of the blade root portion 51 may have a linear shape, be parallel to each other, and inclined with respect to the axial direction of the turbine 6. Further, a center line Lc between the pressure-surface-side contour 53P and the suction-surface-side contour 53S of the blade root portion 51 as the central axis of the blade root portion 51 may be inclined with respect to the axial direction of the turbine 6.

In other words, the center line Lc is a straight line including a line segment connecting widthwise center positions of the blade root portion 51, and the direction of the center line Lc is parallel to the rotor axis C and coincides with the direction in which the turbine blade 40 is inserted into the rotor disc 32.

The airfoil portion 44, the platform 42, the blade root portion 51, and the shank 56 may be integrally formed by casting or the like.

In some embodiments, at any position in the blade height direction of the shank 56, the shank 56 has a cross-section perpendicular to the blade height direction of the airfoil portion 44 in which a line segment S1 connecting a point P1 indicating the widthwise center position of a leading-edge-side end portion 80 of the shank 56 and a point P2 indicating the widthwise center position of a trailing-edge-side end portion 82 of the shank 56 is sloped to the center line Lc between the pressure-surface-side contour 53P of the blade root portion 51 and the suction-surface-side contour 53S of the blade root portion 51, i.e., the central axis of the blade root portion.

Herein, "widthwise" or "width direction" of the shank 56 means a direction crossing the turbine blade 40 from the pressure surface 50 to the suction surface 52 of the airfoil portion 44. The width direction of the shank 56 corresponds to the circumferential direction of the rotor 8.

Embodiments of the turbine blade 40 including the shank 56 having the above-described cross-section will be described with reference to a cross-sectional view of the shank 56.

FIGS. 5 to 9 are a cross-sectional view of the shank 56 of the turbine blade 40 according to an embodiment.

Figure 5:
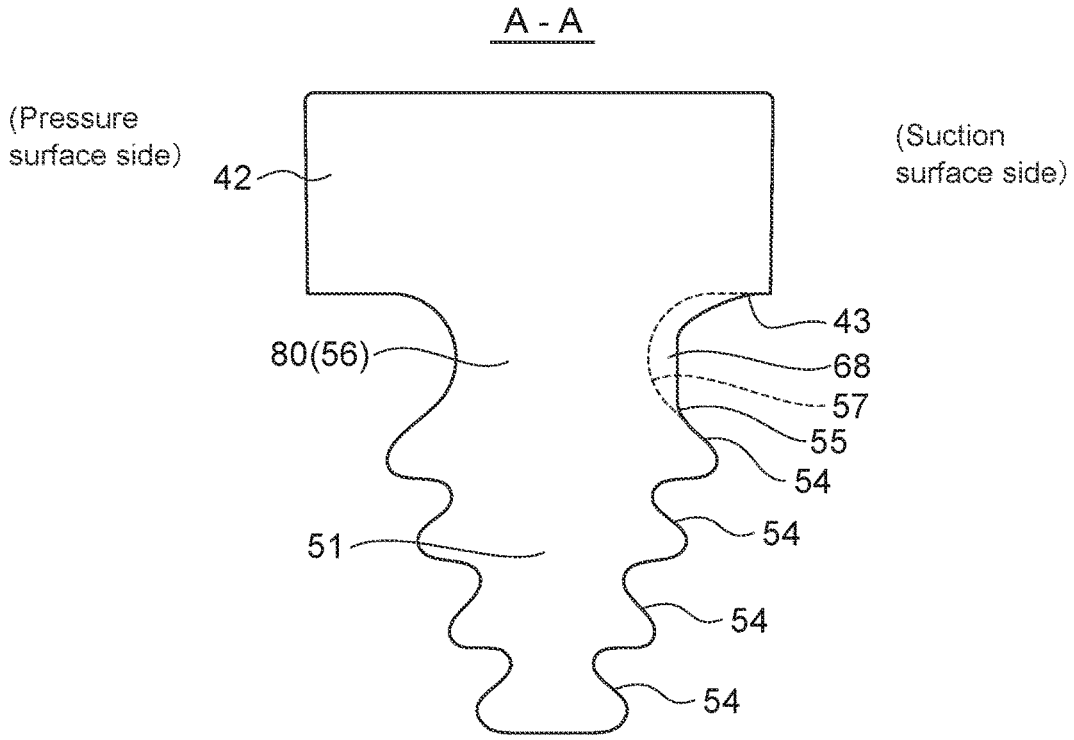
FIG. 5 is a cross-sectional view of a shank of a turbine blade according to an embodiment (cross-section A-A in FIG. 3).
Figure 6:
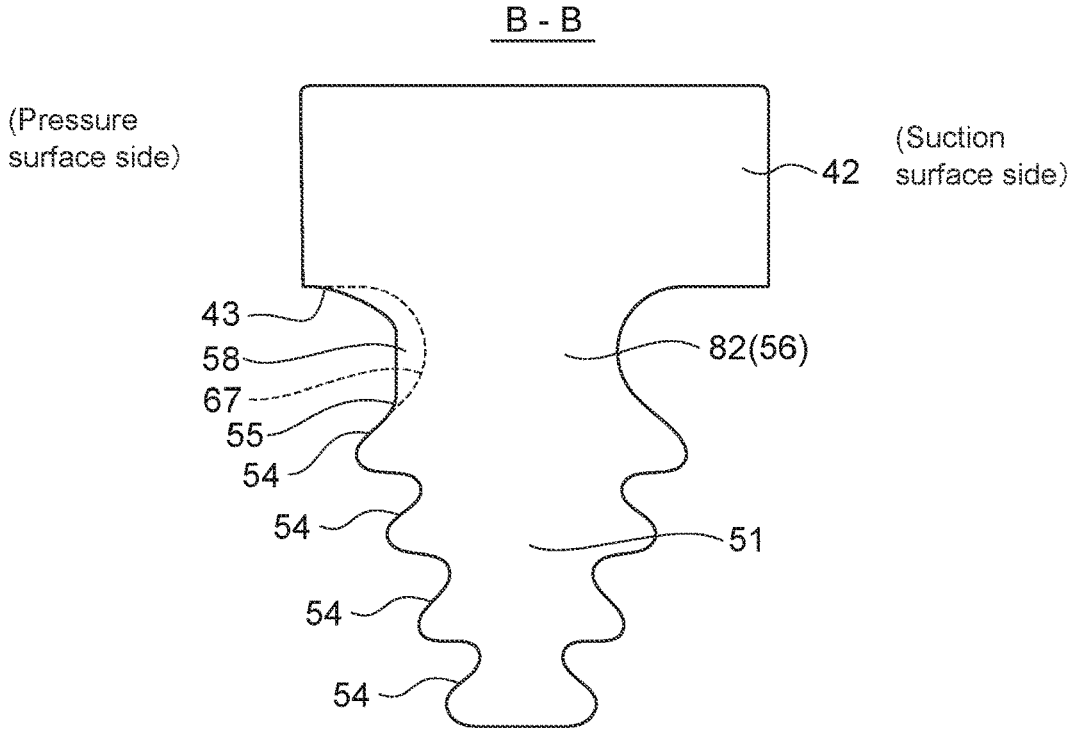
FIG. 6 is a cross-sectional view of a shank of a turbine blade according to an embodiment (cross-section B-B in FIG. 3).
Figure 7:
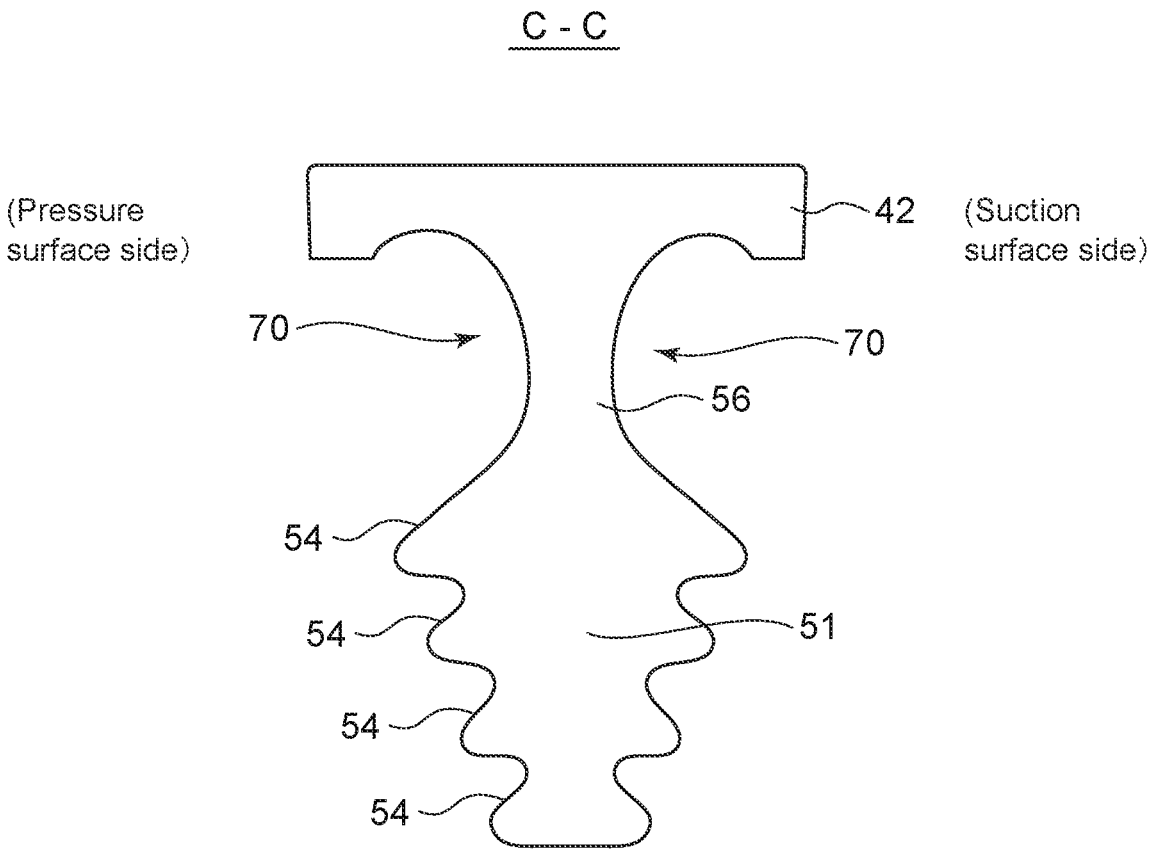
FIG. 7 is a cross-sectional view of a shank of a turbine blade according to an embodiment (cross-section C-C in FIG. 3).

FIGS. 5 to 7 correspond to cross-section A-A, cross-section B-B, and cross-section C-C in FIG. 3, respectively, which are cross-sections including the blade height direction and the width direction of the shank 56 (cross-section viewed from the horizontal direction).

Figure 8:
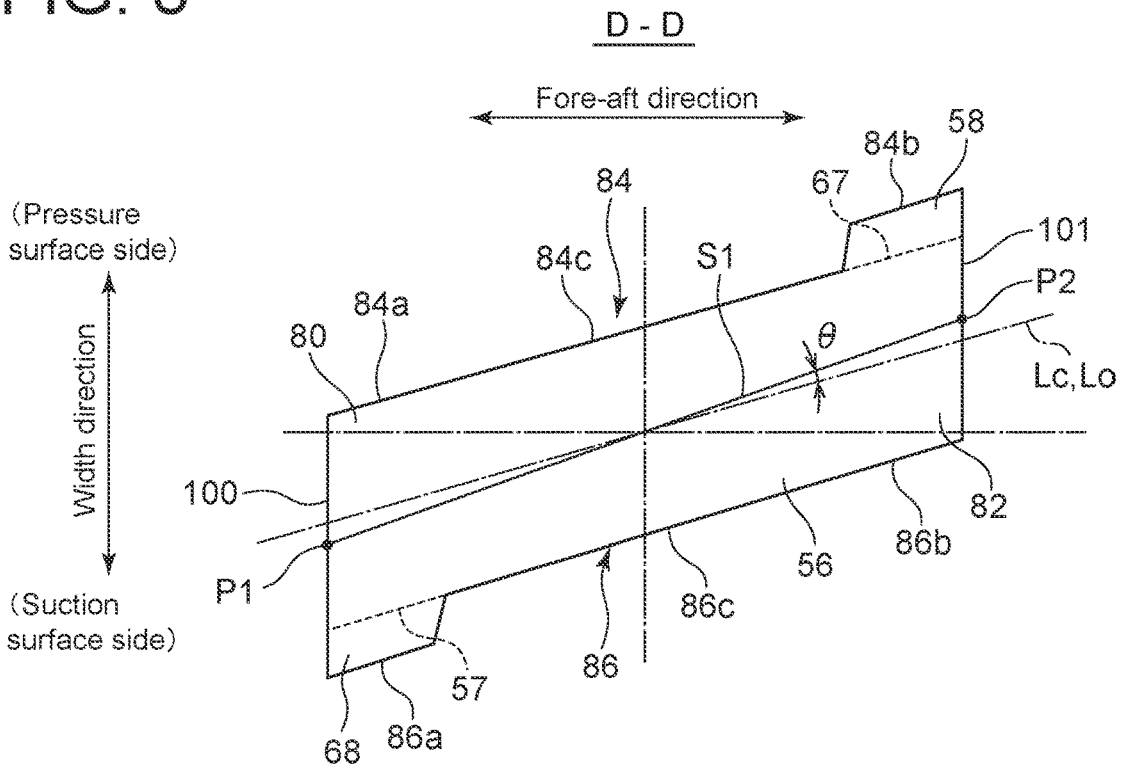
FIG. 8 is a cross-sectional view of a shank of a turbine blade according to an embodiment (cross-section D-D in FIG. 3).
Figure 9:
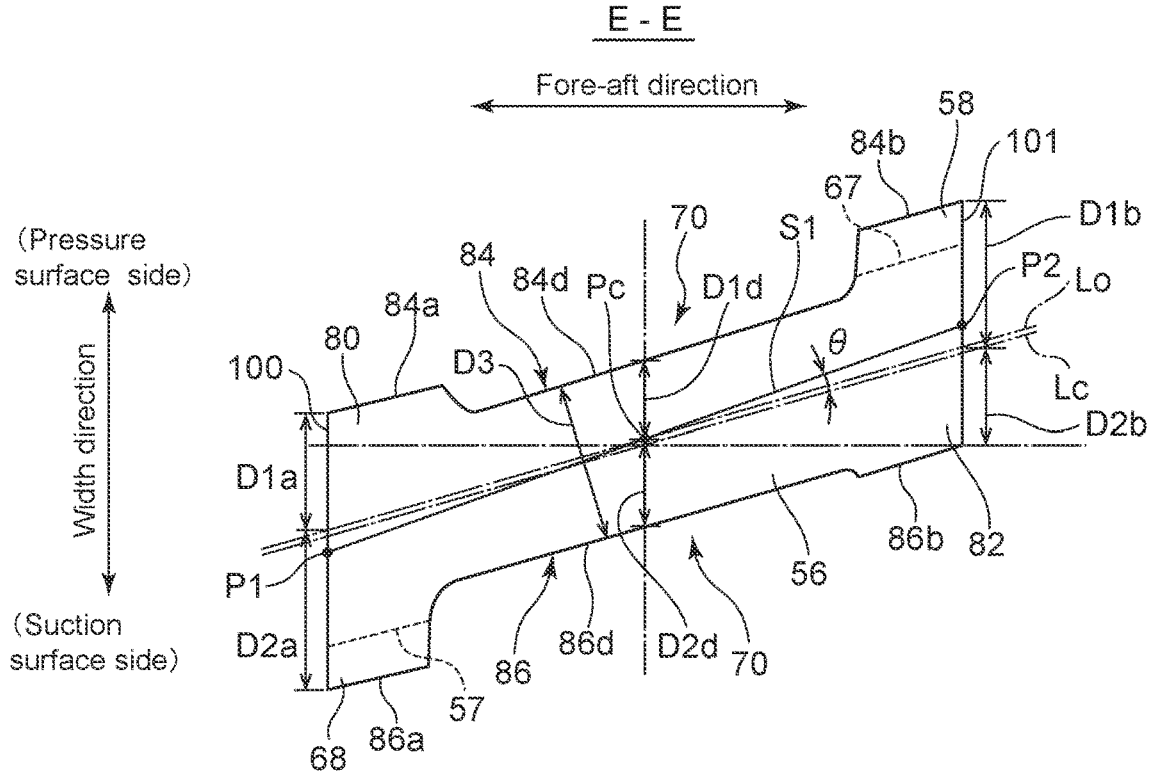
FIG. 9 is a cross-sectional view of a shank of a turbine blade according to an embodiment (cross-section E-E in FIG. 3).

FIGS. 8 and 9 correspond to cross-section D-D and cross-section E-E in FIG. 3, respectively, which are cross-sections of the shank 56 perpendicular to the blade height direction.

As shown in FIGS. 8 and 9, in the shank 56 according to the present embodiment, in the cross-section perpendicular to the blade height direction, a trailing-edge-side region 84*b* of a first contour 84 on the pressure surface side has a first protruding portion (thick portion) 58 (also see FIG. 6). The first protruding portion 58 protrudes circumferentially outward to the pressure surface side compared with a leading-edge-side region 84*a* and an original contour 67 of the trailing-edge-side region 84*b* of the first contour 84.

Further, as shown in the figures, in the shank 56 according to the present embodiment, in the cross-section perpendicular to the blade height direction, a leading-edge-side region 86*a* of a second contour 86 on the suction surface side has a second protruding portion (thick portion) 68 (also see FIG. 5). The second protruding portion 68 protrudes circumferentially outward to the suction surface side compared with a trailing-edge-side region 86*b* and an original contour 57 of the leading-edge-side region 86*a* of the second contour 86.

Herein, "outward to the pressure surface side" and "outward to the suction surface side" mean toward circumferentially outer sides on the pressure surface side and the suction surface side, respectively, with reference to the widthwise center position of the shank 56 in the above-described cross-section.

Further, the dashed lines in FIGS. 5, 6, 8 and 9 indicate contours 57, 67 of the shank before tuning (original contours of the shank 56 when the first protruding portion 58 and the second protruding portion 68 are not provided in the shank 56; i.e., the trailing-edge-side region 84*b* of the first contour 84 on the pressure surface side does not protrude to the pressure surface side compared with the leading-edge-side region 84*a*, and the leading-edge-side region 86*a* of the second contour 86 on the suction surface side does not protrude outward to the suction surface side compared with the trailing-edge-side region 86*b*).

Accordingly, as shown in FIGS. 8 and 9, in the shank 56 according to the present embodiment, in the cross-sections perpendicular to the blade height direction at the positions of the cross-section D-D and the cross-section E-E in FIG. 3 in the height direction, the line segment S1 connecting the point P1 indicating the widthwise center position of the leading-edge-side end portion 80 of the shank 56 and the point P2 indicating the widthwise center position of the trailing-edge-side end portion 82 of the shank 56 is sloped to the center line Lc between the pressure-surface-side contour 53P of the blade root portion 51 and the suction-surface-side contour 53S of the blade root portion 51 (central axis of blade root portion 51). In other words, the angle θ between the line segment S1 and the center line Lc is larger than 0 degrees.

In the above-described embodiment, the shank 56 has a shape protruding in the width direction at a pair of diagonals in the cross-section. More specifically, the shank 56 has a protruding portion (first protruding portion 58 or second protruding portion 68) at a pair of diagonal positions (regions) including the region 84*b* at a side of the pressure surface 50 and the trailing edge 48 and the region 86*a* at a side of the suction surface 52 and the leading edge 46 in the cross-section.

Thus, the stiffness of the shank 56 is increased at the position of the pair of diagonal positions provided with the protruding portions, compared with the case where the protruding portions are not provided. As a result, the natural frequency of a vibration mode in which the airfoil portion 44 vibrates along the center line Lc (i.e., vibration mode in which a relatively large stress occurs at the pair of diagonal positions) is selectively increased. In this way, it is possible to selectively adjust the natural frequency of the above-described specific vibration mode while suppressing the influence on the natural frequency of other vibration modes. Thus, it is possible to reduce damage due to vibration of the turbine blade.

A certain type of turbine blade 40 has multiple vibration modes, for example, B1 mode which is a first bending mode in a direction connecting the pressure surface 50 and the suction surface 52 (pressure-suction direction), A1 mode which is a second bending mode in the rotor axial direction, T1 mode which is a third torsional mode about the axis in the blade height direction, and B2 mode which is a fourth bending mode in the pressure-suction direction.

In such a turbine blade 40, by providing the first protruding portion 58 and the second protruding portion 68 at the pair of diagonal positions, the natural frequency of a vibration mode in which the airfoil portion 44 vibrates along the center line Lc, i.e., the natural frequency of A1 mode is selectively increased.

Further, as shown in FIG. 8, the shank 56 according to the present embodiment has a first cross-section having the following features at the position of the cross-section D-D in FIG. 3 in the blade height direction. Specifically, in the first cross-section, the first contour 84 of the shank 56 at a side of the pressure surface 50 includes the leading-edge-side region 84*a* and a first linear portion 84*c* extending linearly and parallel to the center line Lc of the blade root portion 51 in a region except the trailing-edge-side region 84*b*. Further, the second contour 86 of the shank 56 at a side of the suction surface 52 includes a second linear portion 86*c* extending linearly and parallel to the center line Lc of the blade root portion 51 in a region (including the trailing-edge-side region 86*b*) except the leading-edge-side region 86*a*.

Thus, when the shank 56 has the first cross-section (see FIG. 8) at any blade-height-directional position, in this cross-section (first cross-section), the shank 56 has the first protruding portion 58 and the second protruding portion 68 that can adjust the natural frequency of a vibration mode (typically A1 mode) in which the airfoil portion 44 vibrates along the center line Lc. That is, the first protruding portion 58 and the second protruding portion 68 protrude at the pair of diagonal positions with reference to the first linear portion 84*c* or the second linear portion 86*c* parallel to the center line Lc. Thus, it is possible to selectively adjust the natural frequency of a vibration mode (typically A1 mode) in which the airfoil portion 44 vibrates along the center line Lc.

As shown in FIG. 7, in the present embodiment, the shank 56 has a relatively large undercut portion 70 below the platform 42. The undercut portion 70 formed in the shank 56 partially reduces the width of the shank 56, and thus effectively reduces thermal stress occurring at the connection between the airfoil portion 44 and the platform 42.

The undercut portion 70 may be disposed at an upper part of the shank 56 (portion close to the platform 42) at a middle portion between the leading edge side and the trailing edge side in the fore-aft direction. That is, the undercut portion 70 is provided at a portion where there is no problem in stiffness even when the width of the shank 56 is reduced by provision of the undercut portion 70.

The blade height directional position indicated by the cross-section E-E in FIG. 3 is a height position at which the undercut portion 70 is provided. That is, in the present embodiment, the first protruding portion 58 and the second protruding portion 68 are disposed at the height position at which the undercut portion 70 is provided.

In this case, the cross-section (second cross-section; see FIG. 9) perpendicular to the blade height direction at the position of the cross-section E-E in FIG. 3 has the following features.

Specifically, the first contour 84 of the shank 56 at a side of the pressure surface 50 includes a first leading-edge-side contour 84*a* (corresponding to the above-described leading-edge-side region 84*a*) positioned on the leading edge side, a first trailing-edge-side contour 84*b* (corresponding to the above-described trailing-edge-side region 84*b*) positioned on the trailing edge side; and a first middle contour 84*d* positioned between the first leading-edge-side contour 84*a* and the first trailing-edge-side contour 84*b*.

Further, the second contour 86 of the shank 56 at a side of the suction surface 52 includes a second leading-edge-side contour 86*a* (corresponding to the above-described leading-edge-side region 86*a*) positioned on the leading edge side, a second trailing-edge-side contour 86*b* (corresponding to the above-described trailing-edge-side region 86*b*) positioned on the trailing edge side; and a second middle contour 86*d* positioned between the second leading-edge-side contour 86*a* and the second trailing-edge-side contour 86*b*.

Further, in the second cross-section (see FIG. 9), a distance D1*d* in the circumferential direction from a reference line Lo passing through a midpoint Pc of the line segment S1 and parallel to the center line Lc of the blade root portion 51 to the first middle contour 84*d*, a distance D1*a* in the circumferential direction from the reference line Lo to the first leading-edge-side contour 84*a*, and a distance D1*b* in the circumferential direction from the reference line Lo to the first trailing-edge-side contour 84*b* satisfy a relationship of $D1d<D1a<D1b$.

Further, a distance D2*d* in the circumferential direction from the reference line Lo to the second middle contour 86*d*, a distance D2*a* in the circumferential direction from the reference line Lo to the second leading-edge-side contour 86*a*, and a distance D2*b* in the circumferential direction from the reference line Lo to the second trailing-edge-side contour 86*b* satisfy a relationship of $D2d<D2b<D2a$.

These relationships indicate that, in the cross-section shown in FIG. 9, a middle portion in the fore-aft direction (axial direction) is largely cut out by the undercut portion 70, so that the distances from the reference line Lo to the first middle contour 84*d* and the second middle contour 86*d* positioned at the middle portion in the leading-edge-to-trailing-edge direction are relatively reduced compared with the leading-edge-side end portion and trailing-edge-side end portion. Further, the portions protruding to the pressure surface side on the trailing edge side and to the suction surface side on the leading edge side (first protruding portion 58 and second protruding portion 68) are disposed at the blade-height-directional position at which the undercut portion 70 is provided.

The shank 56 may have the second cross-section (see FIG. 9) at a blade-height-directional position of the shank 56 at which the distance D3 (see FIG. 9) between the first middle contour 84*d* and the second middle contour 86*d* is smallest. In other words, the portions protruding to the pressure surface side on the trailing edge side and to the suction surface side on the leading edge side (first protruding portion 58 and second protruding portion 68) may be disposed at the blade-height-directional position of the shank 56 at which the distance D3 is smallest (blade-height-directional position at which undercut portion 70 is provided).

Thus, since the shank 56 has the second cross-section at the blade-height-directional position at which the shank 56 has the smallest thickness, i.e., at the blade-height-directional position at which the undercut portion 70 is provided, while effectively reducing thermal stress of the turbine blade by the undercut portion 70, it is possible to improve the stiffness at the diagonal positions with the protrusions. Thus, it is possible to adjust the natural frequency of a vibration mode (typically A1 mode) in which the airfoil portion 44 vibrates along the center line Lc. Incidentally, even if the shank 56 has no undercut portion 70, with the portions protruding to the pressure surface side on the trailing edge side and to the suction surface side on the leading edge side (first protruding portion 58 and second protruding portion 68), it is possible to adjust the natural frequency of a vibration mode in which the airfoil portion 44 vibrates along the center line Lc.

In the turbine blade 40 according to the present embodiment, as shown in FIGS. 3, 8, and 9, the shank 56 has both the first cross-section (see FIG. 8) and the second cross-section (FIG. 9) at different positions (positions of cross-section D-D and cross-section E-E in FIG. 3) in the blade height direction.

As shown in FIGS. 5 and 6, the first protruding portion 58 and/or the second protruding portion 68 may extend over the entire range between a lower surface 43 of the platform 42 and an upper end 55 of the bearing surface 54 of the blade root portion 51 in the blade height direction of the shank 56.

The upper end 55 of the bearing surface 54 indicates an upper end, in the blade height direction, of a contact portion between the blade root portion 51 and the blade groove 33 when the blade root portion 51 of the turbine blade 40 is engaged with the blade groove 33 of the rotor disc 32.

In this case, since the first protruding portion 58 and/or the second protruding portion 68 extends over the entire range between the lower surface 43 of the platform 42 and the upper end 55 of the bearing surface 54 in the blade height direction of the shank 56, it is possible to reliably increase the stiffness at the position of the first protruding portion 58 and/or the second protruding portion 68. Thus, it is possible to more effectively adjust the natural frequency of a vibration mode (typically A1 mode) in which the airfoil portion 44 vibrates along the center line Lc.

Further, as shown in FIGS. 8 and 9, in the above-described cross-section (e.g., first cross-section or second cross-section), the first protruding portion 58 and/or the second protruding portion 68 extends linearly along the first middle contour 84*d* of the first contour 84 or the second middle contour of the second contour 86 in parallel to the center line Lc.

That is, the first protruding portion 58 and/or the second protruding portion 68 (thick portion) is disposed over a certain range in the leading-edge-to-trailing-edge direction.

In this case, compared with the case where the shank 56 is not provided with the first protruding portion 58 and/or the second protruding portion 68 (see dashed lines in FIGS. 5, 6, 8, and 9), without significantly changing the shape of the shank 56 especially in the width direction, the stiffness of the shank 56 can be increased at the pair of diagonals, and the natural frequency of the turbine blade 40 can be adjusted.

Figure 10:
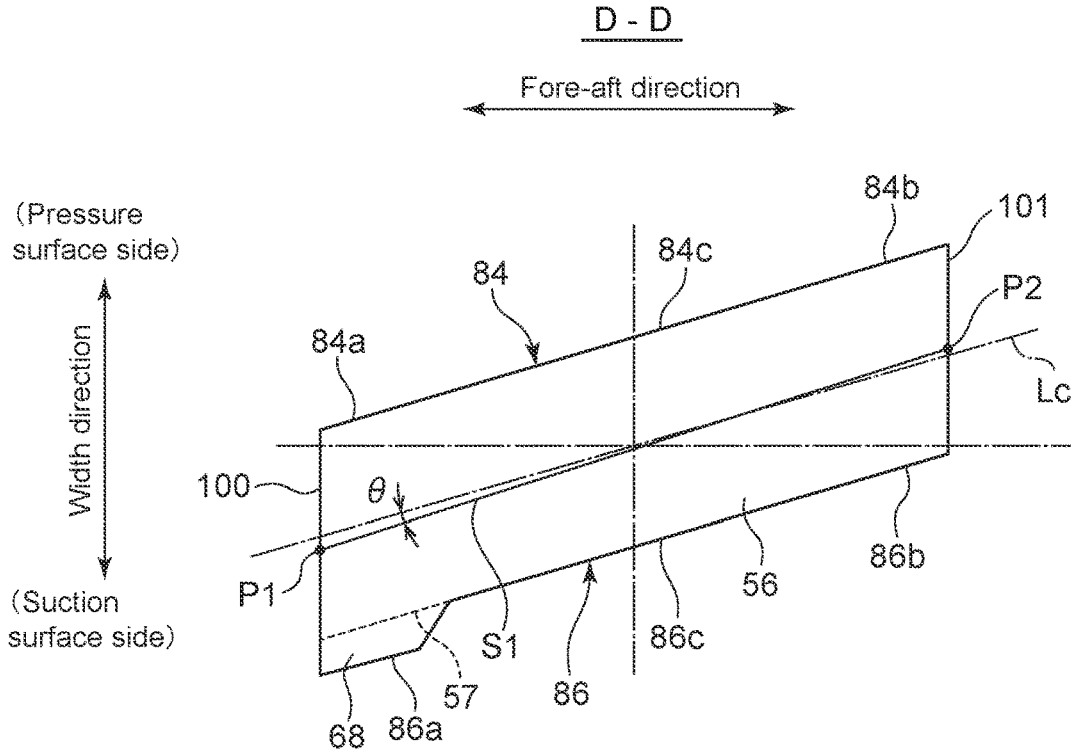
FIG. 10 is a cross-sectional view of a shank of a turbine blade according to an embodiment (cross-section D-D in FIG. 3).

FIG. 10 is a cross-sectional view of the shank 56 according to an embodiment in a cross-section perpendicular to the blade height direction, corresponding to the cross-section D-D in FIG. 3.

In the above-described embodiment, the shank 56 has a shape protruding in the width direction at the pair of diagonals in the cross-section, but in other embodiments, the shank 56 may have a shape protruding (to one side) at one of pair of diagonals in the cross-section.

For instance, as shown in FIG. 10, in the cross-section, the shank 56 may have a protruding portion (second protruding portion 68) at only one of pair of diagonal positions (regions) including the region 84*b* at a side of the pressure surface 50 and the trailing edge 48 and the region 86*a* at a side of the suction surface 52 and the leading edge 46 (in FIG. 10, only in the region 86*a* at a side of the suction surface 52 and the leading edge 46).

That is, as shown in FIG. 10, in the shank 56 according to the present embodiment, in the cross-section perpendicular to the blade height direction at the position of the cross-section D-D in FIG. 3 in the blade height direction, the line segment S1 connecting the widthwise center position P1 of the leading-edge-side end portion 80 of the shank 56 and the widthwise center position P2 of the trailing-edge-side end portion 82 of the shank 56 is sloped to the center line Lc between the pressure-surface-side contour 53P of the blade root portion 51 and the suction-surface-side contour 53S of the blade root portion 51. In other words, the angle θ between the line segment S1 and the center line Lc is larger than 0 degrees.

Thus, the stiffness of the shank 56 is increased at the position of the pair of diagonal positions provided with the protruding portion, compared with the case where the protruding portion is not provided. As a result, the natural frequency of a vibration mode in which the airfoil portion 44 vibrates along the center line Lc (i.e., vibration mode in which a relatively large stress occurs at the pair of diagonal positions; typically A1 mode) is selectively increased. In this way, it is possible to selectively adjust the natural frequency of the above-described specific vibration mode while suppressing the influence on the natural frequency of other vibration modes. Thus, it is possible to reduce damage due to vibration of the turbine blade.

Figure 11:
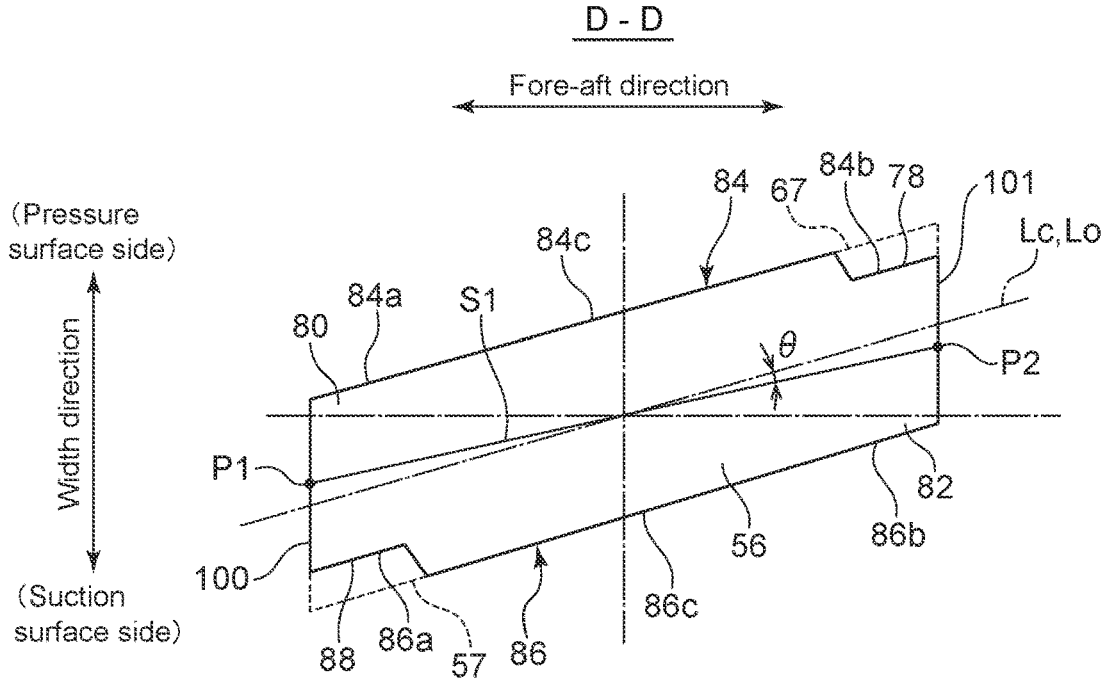
FIG. 11 is a cross-sectional view of a shank of a turbine blade according to an embodiment (cross-section D-D in FIG. 3).
Figure 12:
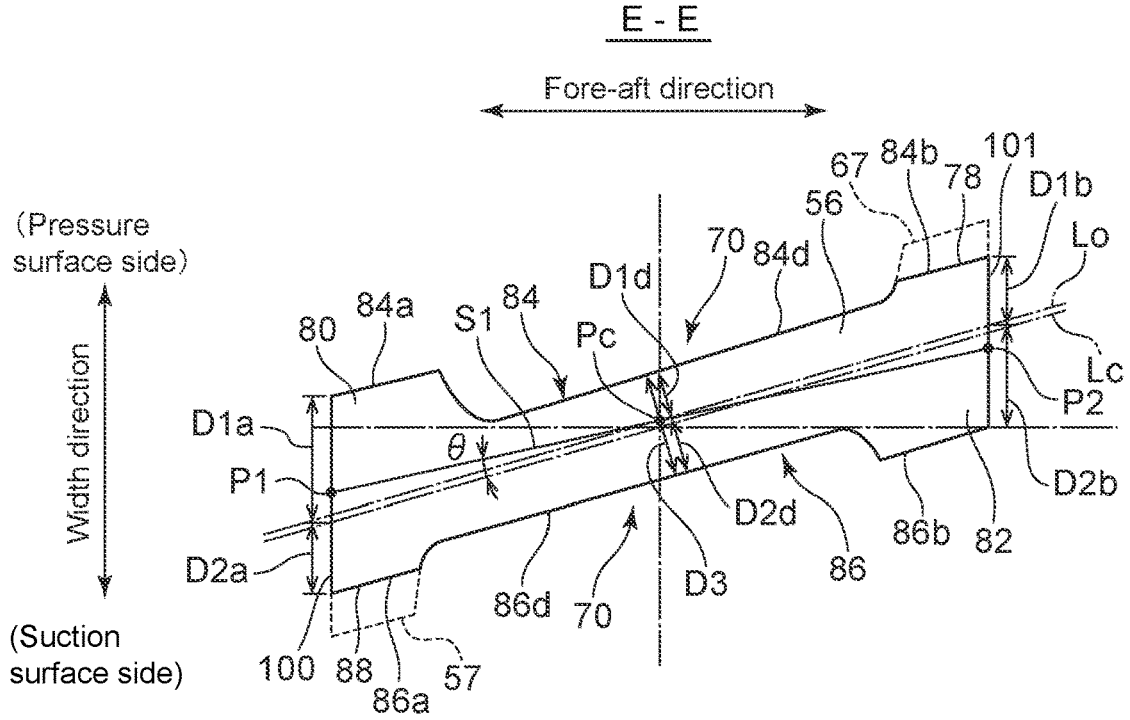
FIG. 12 is a cross-sectional view of a shank of a turbine blade according to an embodiment (cross-section E-E in FIG. 3).

FIGS. 11 to 12 are a cross-sectional view of the turbine blade according to another embodiment different from the turbine blade shown in FIGS. 5 to 9.

FIGS. 11 and 12 correspond to cross-section D-D and cross-section E-E in FIG. 3, respectively, which are cross-sections of the shank 56 perpendicular to the blade height direction.

As shown in FIGS. 11 and 12, in the shank 56 according to the present embodiment, in the cross-section perpendicular to the blade height direction, a trailing-edge-side region 84*b* (first trailing-edge-side region 84*b*) of a first contour 84 on the pressure surface side has a first recess portion (cutout) 78. The first recess portion 78 is recessed inward from the pressure surface side to the suction surface side compared with a leading-edge-side region 84*a* of the first contour 84.

Further, as shown in the figures, in the shank 56 according to the present embodiment, in the cross-section perpendicular to the blade height direction, a leading-edge-side region 86*a* (second leading-edge-side region 86*a*) of a second contour 86 on the suction surface side has a second recess portion (cutout) 88. The second recess portion 88 is recessed inward from the suction surface side to the pressure surface side compared with a trailing-edge-side region 86*b* of the second contour 86.

Herein, "inward from the pressure surface side" and "inward from the suction surface side" mean toward the widthwise center of the shank 56, with reference to the first contour 84 on the pressure surface side and the second contour 86 on the suction surface side, in the above-described cross-section.

Further, the dashed lines in FIGS. 11 and 12 indicate contours (original contours 57, 67) of the shank 56 when the first recess portion 78 and the second recess portion 88 are not provided in the shank 56; i.e., the trailing-edge-side region 84*b* of the first contour 84 on the pressure surface side is not recessed inward from the pressure surface side compared with the leading-edge-side region 84*a*, and the leading-edge-side region 86*a* of the second contour 86 on the suction surface side is not recessed inward from the suction surface side compared with the trailing-edge-side region 86*b*.

Accordingly, as shown in FIGS. 11 and 12, in the shank 56 according to the present embodiment, in the cross-sections perpendicular to the blade height direction at the positions of the cross-section D-D and the cross-section E-E in FIG. 3 in the blade height direction, the line segment S1 connecting the widthwise center position P1 of the leading-edge-side end portion 80 of the shank 56 and the widthwise center position P2 of the trailing-edge-side end portion 82 of the shank 56 is sloped to the center line Lc passing centrally between the pressure-surface-side contour 53P of the blade root portion 51 and the suction-surface-side contour 53S of the blade root portion 51. In other words, the angle θ between the line segment S1 and the center line Lc is larger than 0 degrees.

In the above-described embodiment, the shank 56 has a shape recessed in the width direction at a pair of diagonals in the cross-section. More specifically, the shank 56 has a recess portion (first recess portion 78 or second recess portion 88) at a pair of diagonal positions (regions) including the region 84*b* at a side of the pressure surface 50 and the trailing edge 48 and the region 86*a* at a side of the suction surface 52 and the leading edge 46 in the cross-section.

Thus, the stiffness of the shank 56 is decreased at the position of the pair of diagonal positions provided with the recess portions, compared with the case where the recess portions are not provided. As a result, the natural frequency of a vibration mode in which the airfoil portion 44 vibrates along the center line Lc (i.e., vibration mode in which a relatively large stress occurs at the pair of diagonal positions; typically A1 mode) is selectively decreased. In this way, it is possible to selectively adjust the natural frequency of the above-described specific vibration mode while suppressing the influence on the natural frequency of other vibration modes. Thus, it is possible to reduce damage due to vibration of the turbine blade.

Further, as shown in FIG. 11, the shank 56 according to the present embodiment has a first cross-section having the following features at the position of the cross-section D-D in FIG. 3 in the blade height direction. Specifically, in the first cross-section, the first contour 84 of the shank 56 at a side of the pressure surface 50 includes a first linear portion 84*c* extending linearly and parallel to the center line Lc of the blade root portion 51 in a region (including the leading-edge-side region 84*a*) except the trailing-edge-side region 84*b*. Further, the second contour 86 of the shank 56 at a side of the suction surface 52 includes a second linear portion 86*c* extending linearly and parallel to the center line Lc of the blade root portion 51 in a region (including the trailing-edge-side region 86*b*) except the leading-edge-side region 86*a*.

Thus, when the shank 56 has the first cross-section (see FIG. 11) at any blade-height-directional position, in this cross-section (first cross-section), the shank 56 has the first recess portion 78 and the second recess portion 88 recessed with reference to the first linear portion 84*c* or the second linear portion 86*c* at the pair of diagonal positions that can adjust the natural frequency of a vibration mode (typically A1 mode) in which the airfoil portion 44 vibrates along the center line Lc. Thus, it is possible to selectively adjust the natural frequency of a vibration mode (typically A1 mode) in which the airfoil portion 44 vibrates along the center line Lc.

The height position indicated by the cross-section E-E in FIG. 3 is a blade-height-directional position at which the undercut portion 70 is disposed. In the present embodiment, the first recess portion 78 and the second recess portion 88 are disposed at the blade-height-directional position at which the undercut portion 70 is provided.

In this case, the cross-section (third cross-section; see FIG. 12) perpendicular to the blade height direction at the position of the cross-section E-E in FIG. 3 has the following features.

Specifically, the first contour 84 of the shank 56 at a side of the pressure surface 50 includes a first leading-edge-side contour 84*a* (corresponding to the above-described leading-edge-side region 84*a*) positioned on the leading edge side, a first trailing-edge-side contour 84*b* (corresponding to the above-described trailing-edge-side region 84*b*) positioned on the trailing edge side; and a first middle contour 84*d* positioned between the first leading-edge-side contour 84*a* and the first trailing-edge-side contour 84*b*.

Further, the second contour 86 of the shank 56 at a side of the suction surface 52 includes a second leading-edge-side contour 86*a* (corresponding to the above-described leading-edge-side region 86*a*) positioned on the leading edge side, a second trailing-edge-side contour 86*b* (corresponding to the above-described trailing-edge-side region 86*b*) positioned on the trailing edge side; and a second middle contour 86*d* positioned between the second leading-edge-side contour 86*a* and the second trailing-edge-side contour 86*b*.

Further, in the third cross-section (see FIG. 12), a distance D1*d* in the circumferential direction from a reference line Lo passing through a midpoint Pc of the line segment S1 and parallel to the center line Lc of the blade root portion 51 to the first middle contour 84*d*, a distance D1*a* in the circumferential direction from the reference line Lo to the first leading-edge-side contour 84*a*, and a distance D1*b* in the circumferential direction from the reference line Lo to the first trailing-edge-side contour 84*b* satisfy a relationship of D1*d*<D1*b*<D1*a*.

Further, a distance D2*d* in the circumferential direction from the reference line Lo to the second middle contour 86*d*, a distance D2*a* in the circumferential direction from the reference line Lo to the second leading-edge-side contour 86*a*, and a distance D2*b* in the circumferential direction from the reference line Lo to the second trailing-edge-side contour 86*b* satisfy a relationship of D2*d*<D2*a*<D2*b*.

These relationships indicate that, in the cross-section shown in FIG. 12, a middle portion in the fore-aft direction (axial direction) is largely cut out by the undercut portion 70, so that the distances from the reference line Lo to the first middle contour 84*d* and the second middle contour 86*d* positioned at the middle portion in the fore-aft direction are relatively reduced compared with the leading-edge-side end portion or trailing-edge-side end portion. Further, the portions recessed from the pressure surface side on the trailing edge side and from the suction surface side on the leading edge side with reference to the original contours 57, 67 (first recess portion 78 and second recess portion 88) are disposed at the blade-height-directional position at which the undercut portion 70 is provided.

The shank 56 may have the third cross-section (see FIG. 12) at a blade-height-directional position of the shank 56 at which the distance D3 (FIG. 12) between the first middle contour 84*d* and the second middle contour 86*d* is smallest. In other words, the portions recessed from the pressure surface side on the trailing edge side and from the suction surface side on the leading edge side with reference to the original contours 57, 67 (first recess portion 78 and second recess portion 88) may be disposed at the blade-height-directional position of the shank 56 at which the distance D3 is smallest (blade-height-directional position at which undercut portion 70 is provided).

Thus, since the shank 56 has the third cross-section at the blade-height-directional position at which the shank 56 has the smallest thickness, i.e., at the blade-height-directional position at which the undercut portion 70 is provided, while effectively reducing thermal stress of the turbine blade 40 (especially, thermal stress occurring at the connection between the airfoil portion 44 and the platform 42) by the undercut portion 70, it is possible to decrease the stiffness at the diagonal positions with the recesses. Thus, it is possible to adjust the natural frequency of a vibration mode (typically A1 mode) in which the airfoil portion 44 vibrates along the center line Lc. Incidentally, even if the shank 56 has no undercut portion 70, with the portions recessed from the pressure surface side on the trailing edge side and from the suction surface side on the leading edge side (first recess portion 78 and second recess portion 68), it is possible to adjust the natural frequency of a vibration mode in which the airfoil portion 44 vibrates along the center line Lc.

In the turbine blade 40 according to the present embodiment, as shown in FIGS. 3, 11, and 12, the shank 56 has both the first cross-section (see FIG. 11) and the third cross-section (FIG. 12) at different positions (positions of cross-section D-D and cross-section E-E in FIG. 3) in the blade height direction.

Although not particularly depicted, the first recess portion 78 and/or the second recess portion 88 may extend over the entire range between the lower surface 43 of the platform 42 and the upper end 55 of the bearing surface 54 of the blade root portion 51 in the blade height direction of the shank 56.

In this case, since the first recess portion 78 and/or the second recess portion 88 extends over the entire range between the lower surface 43 of the platform 42 and the upper end 55 of the bearing surface 54 in the blade height direction of the shank 56, it is possible to reliably decrease the stiffness at the position of the first recess portion 78 and/or the second recess portion 88. Thus, it is possible to more effectively adjust the natural frequency of a vibration mode (typically A1 mode) in which the airfoil portion 44 vibrates along the center line Lc.

Further, as shown in FIGS. 11 and 12, in the above-described cross-section (e.g., first cross-section or third cross-section), the first recess portion 78 and/or the second recess portion 88 extends linearly and parallel to the center line Lc.

That is, the first recess portion 78 and/or the second recess portion 88 (cutout) is provided over a certain range in the fore-aft direction.

In this case, compared with the case where the shank 56 is not provided with the first recess portion 78 and/or the second recess portion 88 (see dashed line in FIGS. 11 and 12), without significantly changing the shape of the shank 56 especially in the width direction, the stiffness of the shank 56 can be decreased at the pair of diagonals, and the natural frequency of the turbine blade 40 can be adjusted.

Figure 13:
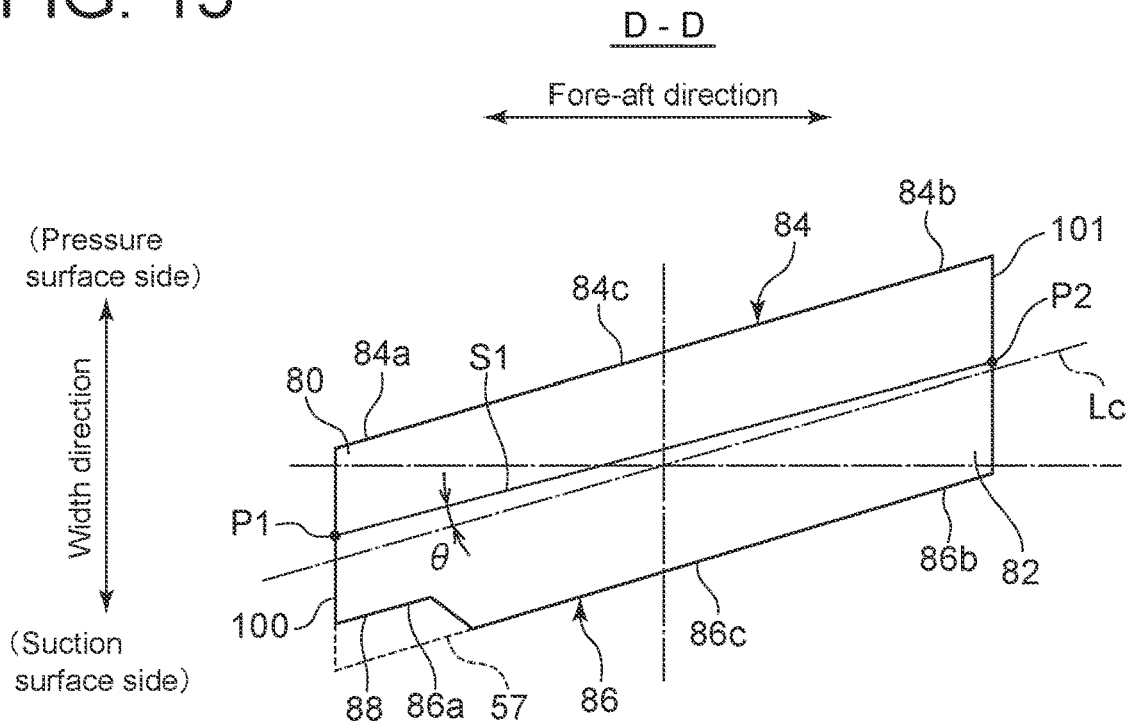
FIG. 13 is a cross-sectional view of a shank of a turbine blade according to an embodiment (cross-section D-D in FIG. 3).

FIG. 13 is a cross-sectional view of the shank 56 according to an embodiment in a cross-section perpendicular to the blade height direction, corresponding to the cross-section D-D in FIG. 3.

In the above-described embodiment, the shank 56 has a shape protruding in the width direction at the pair of diagonals in the cross-section, but in other embodiments, the shank 56 may have a shape protruding in the width direction at one of pair of diagonals in the cross-section.

For instance, as shown in FIG. 13, in the cross-section, the shank 56 may have a recess portion (second recess portion 88) at only one of pair of diagonal positions (regions) including the region 84*b* at a side of the pressure surface 50 and the trailing edge 48 and the region 86*a* at a side of the suction surface 52 and the leading edge 46 (in FIG. 13, only in the region 86*a* at a side of the suction surface 52 and the leading edge 46).

Accordingly, as shown in FIG. 13, in the shank 56 according to the present embodiment, in the cross-section perpendicular to the blade height direction at the position of the cross-section D-D in FIG. 3 in the blade height direction, the line segment S1 connecting the widthwise center position P1 of the leading-edge-side end portion 80 of the shank 56 and the widthwise center position P2 of the trailing-edge-side end portion 82 of the shank 56 is sloped to the center line Lc between the pressure-surface-side contour 53P of the blade root portion 51 and the suction-surface-side contour 53S of the blade root portion 51. In other words, the angle θ between the line segment S1 and the center line Lc is larger than 0 degrees.

Thus, the stiffness of the shank 56 is decreased at the position of the pair of diagonal positions provided with the protruding portion, compared with the case where the protruding portion is not provided. As a result, the natural frequency of a vibration mode in which the airfoil portion 44 vibrates along the center line Lc (i.e., vibration mode in which a relatively large stress occurs at the pair of diagonal positions; typically A1 mode) is selectively decreased. In this way, it is possible to selectively adjust the natural frequency of the above-described specific vibration mode while suppressing the influence on the natural frequency of other vibration modes. Thus, it is possible to reduce damage due to vibration of the turbine blade.

Figure 14:
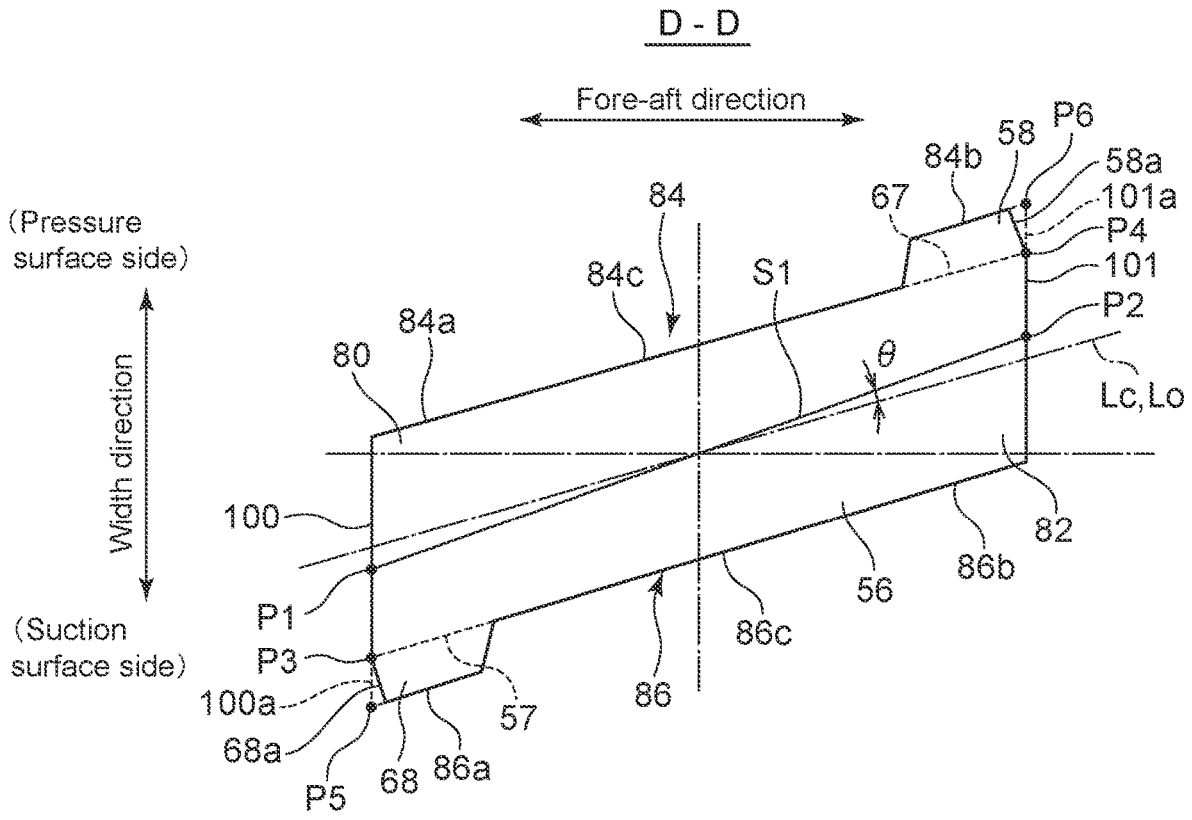
FIG. 14 is a cross-sectional view of a shank of a turbine blade according to an embodiment (cross-section D-D in FIG. 3).

FIG. 14 is a cross-sectional view of the shank 56 according to an embodiment in a cross-section perpendicular to the blade height direction, and shows a modified example of the embodiment shown in FIG. 8.

In this embodiment, the shapes of the first protruding portion 58 and the second protruding portion 68 differ from those in the embodiment shown in FIG. 8. Specifically, the first protruding portion 58 includes a first inclined surface 58*a* facing a side of an aftermost end surface 101 on the trailing edge side, in the shape protruding circumferentially outward at the trailing edge and pressure surface side with reference to the first linear portion 84*c* (original contour 67). In other words, the first inclined surface 58*a* is a surface extending starting from a pressure-surface-side edge P4 of the aftermost end surface 101 to the circumferentially outer side and the leading edge side and connected to the first trailing-edge-side contour 84*b*, and this surface is inclined with respect to the aftermost end surface 101. Similarly, the second protruding portion 68 includes a second inclined surface 68*a* facing a side of a foremost end surface 100 on the leading edge side, in the side shape protruding circumferentially outward at the leading edge and suction surface side with reference to the second linear portion 86*c* (original contour 57). In other words, the second inclined surface 68*a* is a surface extending starting from a suction-surface-side edge P3 of the foremost end surface 100 to the circumferentially outer side and the trailing edge side and connected to the second leading-edge-side contour 86*a*, and this surface is inclined with respect to the foremost end surface 100. The present embodiment differs from the embodiment shown in FIG. 8 in that the first protruding portion 58 includes the first inclined surface 58*a*, and the second protruding portion 68 includes the second inclined surface 68*a*.

Accordingly, as with the embodiment shown in FIG. 8, the stiffness of the shank 56 is increased at the position of the pair of diagonal positions provided with the first protruding portion 58 and the second protruding portion 68, compared with the case where the protruding portions are not provided. Thus, it is possible to selectively increase the natural frequency of a vibration mode in which the airfoil portion 44 vibrates along the center line Lc.

Although in the first protruding portion 58 or the second protruding portion 68 according to the embodiments shown in FIGS. 8 to 14, the first trailing-edge-side contour 84*b* or the second leading-edge-side contour 86*a* forming the circumferentially outer edge is formed as an outer surface having a linear portion parallel to the center line Lc of the shank 56, they may have a convex outer shape protruding circumferentially outward, instead of the linear portion.

Herein, the leading-edge-side or trailing-edge-side "end portion" of the shank 56 fundamentally means a flat surface indicating the leading-edge-side foremost end surface 100 or the trailing-edge-side aftermost end surface 101 of the shank 56. However, in the case where the first protruding portion 58 or the second protruding portion 68 includes the first inclined surface 58*a* starting from the edge P4 or the second inclined surface 68*a* starting from the edge P3 as in the embodiment shown in FIG. 14, the end portion is interpreted as including a range of extension of the foremost end surface 100 extending circumferentially outward on the suction surface side or extension of the aftermost end surface 101 extending circumferentially outward on the pressure surface side. In other words, as shown in FIG. 14, when P6 is an intersection between the extension line of the first trailing-edge-side contour 84*b* forming the outer edge of the first protruding portion 58 and the extension plane of the aftermost end surface 101 extending circumferentially outward on the pressure surface side, the points P4 and P6 define an aftermost end extension portion 101*a* extending the aftermost end surface 101 to the circumferentially outward on the pressure surface side. The trailing-edge-side "end portion" including the present embodiment may be regarded as a flat plane in a range including the aftermost end surface 101 and the aftermost end extension portion 101*a*. Similarly, regarding the second protruding portion 68, when P5 is an intersection between the extension line of the second trailing-edge-side contour 86*a* forming the outer edge of the second protruding portion 68 and the extension plane of the foremost end surface 100 extending circumferentially outward on the suction surface side, the points P3 and P5 define a foremost end extension portion 100*a* extending the foremost end surface 100 to the circumferentially outward on the suction surface side. The leading-edge-side "end portion" including the present embodiment may be regarded as a flat plane in a range including the foremost end surface 100 and the foremost end extension portion 100*a*.

Even when the protrusion starting position of the first protruding portion 58 or the second protruding portion 68 of the embodiments shown in FIGS. 8 to 14 protruding circumferentially outward on the trailing edge and pressure surface side or the leading edge and suction surface side with reference to the original contour 57, 67 is located on a further leading edge or trailing edge side than the edge P4 of the aftermost end surface 101 on the pressure surface side or the edge P3 of the foremost end surface 100 on the suction surface side along the original contour 57, 67, a range from the foremost end surface 100 on the leading edge side or the aftermost end surface 101 on the trailing edge side of the shank 56, in the trailing edge direction or the leading edge direction, up to 20% of the total length of the shank 56 in the leading-edge-to-trailing-edge direction may be interpreted as the "end portion".

When the "end portion" is interpreted in this range, it is easy to determine whether natural frequency is selectively effective in a specific vibration mode (for example, A1 mode) in which the airfoil portion 44 vibrates along the center line Lc.

Accordingly, even if the line segment S1 (P1P2) connecting the widthwise center position P1 of the shank 56 on the foremost end surface 100 of the shank 56 and the widthwise center position P2 of the shank 56 on the aftermost end surface 101 of the shank 56 is parallel to the center line Lc, it suffices that the line segment S1 is inclined with respect to the center line Lc within the range described previously as the "end portion".

Here, when the widthwise length of the shank 56 is variable at the end portion, a point obtained by moving the average widthwise center position of the shank 56 in the above-described range, in parallel to the center line Lc, to the foremost end surface 100 or the aftermost end surface 101 is defined as the widthwise center position P1 of the end portion 80 and the widthwise center position P2 of the end portion 82

Next, a method of tuning the natural frequency of the turbine blade 40 according to some embodiments will be described.

In some embodiments, the method is applied to the turbine blade 40 described with reference to FIGS. 2 to 9 and the turbine blade 40 described with reference to FIGS. 11 and 12.

Specifically, the turbine blade 40 to be tuned includes the platform 42, the airfoil portion 44, the blade root portion 51, and the shank 56, as described above. Further, the shank 56 has the above-described cross-section (e.g., first cross-section to third cross-section) at any position in the blade height direction. More specifically, this cross-section is a cross-section perpendicular to the blade height direction in which the line segment S1 connecting the widthwise center position P1 of the end portion 80 of the shank 56 at a side of the leading edge 46 and the widthwise center position P2 of the end portion 82 of the shank 56 at a side of the trailing edge 48 is sloped to the center line Lc between the contour 53P of the blade root portion 51 at a side of the pressure surface 50 and the contour 53S of the blade root portion 51 at a side of the suction surface 52.

The tuning method according to some embodiments includes a step of processing the outer shape of the shank 56 so as to change an angle θ of the line segment S1 with respect to the center line Lc of the blade root portion 51.

In some embodiments, the natural frequency of a mode (typically A1 mode) in which the airfoil portion 44 of the turbine blade 40 vibrates along the center line Lc may be adjusted by processing the outer shape of the shank 56 as described above.

More specifically, for instance, in the case of the turbine blade 40 shown in FIGS. 5 to 9 (i.e., the turbine blade 40 having the shank 56 provided with the first protruding portion 58 and the second protruding portion 68 at the pair of diagonals), in the step of processing the outer shape, the protrusion amount of the first protruding portion 58 in the width direction of the shank 56 or the size of a range of the first contour 84 occupied by the first protruding portion 58 may be adjusted. Alternatively or additionally, the protrusion amount of the second protruding portion 68 in the width direction of the shank 56 or the size of a range of the second contour 86 occupied by the second protruding portion 68 may be adjusted.

Meanwhile, for instance, in the case of the turbine blade 40 shown in FIGS. 11 and 12 (i.e., the turbine blade 40 having the shank 56 provided with the first recess portion 78 and the second recess portion 88 at the pair of diagonals), in the step of processing the outer shape, the recess amount of the first recess portion 78 in the width direction of the shank 56 or the size of a range of the first contour 84 occupied by the first recess portion 78 may be adjusted. Alternatively or additionally, the recess amount of the second recess portion 88 in the width direction of the shank 56 or the size of a range of the second contour 86 occupied by the second recess portion 88 may be adjusted.

Thus, in the shank 56, it is possible to adjust the stiffness at the pair of diagonal positions provided with the protruding portions or the recess portions. That is, it is possible to increase the stiffness by increasing the protrusion amount of the protruding portion or the size of the range occupied by the protruding portion, or by decreasing the recess amount of the recess portion or the size of the range occupied by the recess portion. Further, it is possible to decrease the stiffness by decreasing the protrusion amount of the protruding portion or the size of the range occupied by the protruding portion, or by increasing the recess amount of the recess portion or the size of the range occupied by the recess portion.

Thus, by adjusting the stiffness of the shank 56 at the pair of diagonal positions with the protruding portions or the recess portions, it is possible to selectively increase or decrease the natural frequency of a vibration mode (typically A1 mode) in which a relatively large stress occurs at the pair of diagonal positions. In this way, it is possible to selectively adjust the natural frequency of a specific vibration mode while suppressing the influence on the natural frequency of other vibration modes. Thus, it is possible to reduce damage due to vibration of the turbine blade.

In some embodiments, the turbine blade 40 to be tuned includes the platform 42, the airfoil portion 44, the blade root portion 51 having the bearing surface 54, and the shank 56 (see FIGS. 2 and 3). That is, in this embodiment, the turbine blade 40 may not have the above-described protruding portion or recess portion at the pair of diagonal positions.

The tuning method according to this embodiment includes a step of processing the outer shape of the shank 56 in at least one of a region of the first contour 84 at a side of the trailing edge 48 and the pressure surface 50 of the shank 56 or a region of the second contour 86 at a side of the leading edge 46 and the suction surface 52 of the shank 56 (for example, see FIGS. 8 and 11).

With the method according to the above-described embodiment, since the outer shape of the shank 56 is processed in at least one of a region at a side of the trailing edge 48 and the pressure surface 50 of the shank 56 or a region at a side of the leading edge 46 and the suction surface 52 of the shank 56, the shank 56 is processed into a shape protruding or recessed in the width direction at at least one of pair of diagonal positions. Thus, the stiffness of the shank 56 is increased or decreased at the diagonal position, so that it is possible to selectively increase or decrease the natural frequency of a vibration mode (typically A1 mode) in which a relatively large stress occurs at the pair of diagonal positions. In this way, it is possible to selectively adjust the natural frequency of a specific vibration mode while suppressing the influence on the natural frequency of other vibration modes. Thus, it is possible to reduce damage due to vibration of the turbine blade.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

REFERENCE SIGNS LIST

1 Gas turbine
2 Compressor
4 Combustor
6 Turbine
8 Rotor
10 Compressor casing
12 Air inlet
16 Stator blade
18 Rotor blade
20 Casing
22 Turbine casing
24 Stator blade
26 Rotor blade
28 Combustion gas passage
30 Exhaust chamber
32 Rotor disc
33 Blade groove
34 Cooling passage
36 Rib
38 Inner wall surface
40 Turbine blade
42 Platform
43 Lower surface
44 Airfoil portion
46 Leading edge
48 Trailing edge
50 Pressure surface
51 Blade root portion
52 Suction surface
53P Contour
53 S Contour
54 Bearing surface
55 Upper end
56 Shank
57 Original contour
58 First protruding portion
67 Original contour
68 Second protruding portion
70 Undercut portion
78 First recess portion
80 End portion
82 End portion
84 First contour
84*a* First leading-edge-side contour (Leading-edge-side region)
84*b* First trailing-edge-side contour (Trailing-edge-side region)
84*c* First linear portion
84*d* First middle contour
86 Second contour
86*a* Second leading-edge-side contour (Leading-edge-side region)

86*b* Second trailing-edge-side contour (Trailing-edge-side region)
86*c* Second linear portion
86*d* Second middle contour
88 Second recess portion
100 Foremost end surface
100*a* Foremost end extension portion
101 Aftermost end surface
101*a* Aftermost end extension portion
Lc Center line
Lo Reference line
P1 Center position
P2 Center position
Pc Midpoint
S1 Line segment

The invention claimed is:

1. A turbine blade comprising:

a platform;

an airfoil portion extending from the platform in a blade height direction and having a pressure surface and a suction surface extending between a leading edge and a trailing edge;

a blade root portion positioned opposite to the airfoil portion across the platform in the blade height direction and having a bearing surface; and a shank positioned between the platform and the blade root portion, wherein the shank has a cross-section which is perpendicular to the blade height direction of the airfoil portion, and in which a line segment connecting a widthwise center position of a leading-edge-side end portion of the shank and a widthwise center position of a trailing-edge-side end portion of the shank is sloped to a center line between a pressure-surface-side contour of the blade root portion and a suction-surface-side contour of the blade root portion, wherein the shank has the cross-section satisfying at least one of the following conditions:

(a) the shank has a first contour on a pressure surface side, and a trailing-edge-side region of the first contour has a first protruding portion protruding outward to the pressure surface side compared with a leading-edge-side region of the first contour; or (b) the shank has a second contour on a suction surface side, and a leading-edge-side region of the second contour has a second protruding portion protruding outward to the suction surface side compared with a trailing-edge-side region of the second contour, and wherein at least one of the first protruding portion or the second protruding portion extends linearly and parallel to the center line in the cross-section.

2. The turbine blade according to claim 1, wherein the first contour of the shank on the pressure surface side includes:

a first leading-edge-side contour positioned on a leading edge side;

a first trailing-edge-side contour positioned on a trailing edge side; and a first middle contour positioned between the first leading-edge-side contour and the first trailing-edge-side contour, wherein the second contour of the shank on the suction surface side includes:

a second leading-edge-side contour positioned on a leading edge side;

a second trailing-edge-side contour positioned on a trailing edge side; and a second middle contour positioned between the second leading-edge-side contour and the second trailing-edge-side contour, and wherein at least one of the first protruding portion or the second protruding portion extends, in a height direction of the shank, over a range in the blade height direction including a blade-height-directional position at which a distance between the first middle contour and the second middle contour is smallest and including both sides of the blade-height-directional position.

3. The turbine blade according to claim 2, wherein at least one of the first protruding portion or the second protruding portion extends, in the blade height direction of the shank, over an entire range between a lower surface of the platform and an upper end of the bearing surface.

4. The turbine blade according to claim 1, wherein the shank has the cross-section satisfying at least one of the following conditions:

(c) the shank has a first contour on a pressure surface side, and a trailing-edge-side region of the first contour has a first recess portion recessed inward from the pressure surface side compared with a leading-edge-side region of the first contour; or (d) the shank has a second contour on a suction surface side, and a leading-edge-side region of the second contour has a second recess portion recessed inward from the suction surface side compared with a trailing-edge-side region of the second contour.

5. A turbine comprising:

the turbine blade according to claim 1; and a rotor disc having a blade groove engaged with the blade root portion of the turbine blade.

6. A turbine blade comprising:

a platform;

an airfoil portion extending from the platform in a blade height direction and having a pressure surface and a suction surface extending between a leading edge and a trailing edge;

a blade root portion positioned opposite to the airfoil portion across the platform in the blade height direction and having a bearing surface; and a shank positioned between the platform and the blade root portion, wherein the shank has a cross-section which is perpendicular to the blade height direction of the airfoil portion, and in which a line segment connecting a widthwise center position of a leading-edge-side end portion of the shank and a widthwise center position of a trailing-edge-side end portion of the shank is sloped to a center line between a pressure-surface-side contour of the blade root portion and a suction-surface-side contour of the blade root portion, wherein, the shank is configured such that, in the cross-section, a first contour of the shank on a pressure surface side includes a first linear portion extending linearly and parallel to the center line of the blade root portion in a region except a trailing-edge-side region, or a second contour of the shank on a suction surface side includes a second linear portion extending linearly and parallel to the center line of the blade root portion in a region except a leading-edge-side region.

7. A turbine comprising:

the turbine blade according to claim 6; and a rotor disc having a blade groove engaged with the blade root portion of the turbine blade.

8. A turbine blade comprising:

a platform;

an airfoil portion extending from the platform in a blade height direction and having a pressure surface and a suction surface extending between a leading edge and a trailing edge;

a blade root portion positioned opposite to the airfoil portion across the platform in the blade height direction and having a bearing surface; and a shank positioned between the platform and the blade root portion, wherein the shank has a cross-section which is perpendicular to the blade height direction of the airfoil portion, and in which a line segment connecting a widthwise center position of a leading-edge-side end portion of the shank and a widthwise center position of a trailing-edge-side end portion of the shank is sloped to a center line between a pressure-surface-side contour of the blade root portion and a suction-surface-side contour of the blade root portion, wherein a first contour of the shank on a pressure surface side includes:

a first leading-edge-side contour positioned on a leading edge side;

a first trailing-edge-side contour positioned on a trailing edge side; and a first middle contour positioned between the first leading-edge-side contour and the first trailing-edge-side contour, wherein a second contour of the shank on a suction surface side includes:

a second leading-edge-side contour positioned on a leading edge side;

a second trailing-edge-side contour positioned on a trailing edge side; and a second middle contour positioned between the second leading-edge-side contour and the second trailing-edge-side contour, and wherein the shank has the cross-section satisfying at least one of the following conditions:

(e) a distance from a reference line passing through a midpoint of the line segment and parallel to the center line of the blade root portion increases in order of the first middle contour, the first leading-edge-side contour, and the first trailing-edge-side contour; or (f) a distance from the reference line increases in order of the second middle contour, the second trailing-edge-side contour, and the second leading-edge-side contour.

9. The turbine blade according to claim 8, wherein the shank has the cross section satisfying at least one of the condition (e) or (f) at a position, in a height direction of the shank, at which a distance between the first middle contour and the second middle contour is smallest.

10. A turbine comprising:

the turbine blade according to claim 8; and a rotor disc having a blade groove engaged with the blade root portion of the turbine blade.

11. A turbine blade comprising:

a platform;

an airfoil portion extending from the platform in a blade height direction and having a pressure surface and a suction surface extending between a leading edge and a trailing edge;

a blade root portion positioned opposite to the airfoil portion across the platform in the blade height direction and having a bearing surface; and a shank positioned between the platform and the blade root portion, wherein the shank has a cross-section which is perpendicular to the blade height direction of the airfoil portion, and in which a line segment connecting a widthwise center position of a leading-edge-side end portion of the shank and a widthwise center position of a trailing-edge-side end portion of the shank is sloped to a center line between a pressure-surface-side contour of the blade root portion and a suction-surface-side contour of the blade root portion, wherein a first contour of the shank on a pressure surface side includes:

a first leading-edge-side contour positioned on a leading edge side;

a first trailing-edge-side contour positioned on a trailing edge side; and a first middle contour positioned between the first leading-edge-side contour and the first trailing-edge-side contour, wherein a second contour of the shank on a suction surface side includes:

a second leading-edge-side contour positioned on a leading edge side;

a second trailing-edge-side contour positioned on a trailing edge side; and a second middle contour positioned between the second leading-edge-side contour and the second trailing-edge-side contour, and wherein the shank has the cross-section satisfying at least one of the following conditions:

(g) a distance from a reference line passing through a midpoint of the line segment and parallel to the center line of the blade root portion increases in order of the first middle contour, the first trailing-edge-side contour, and the first leading-edge-side contour; or (h) a distance from the reference line increases in order of the second middle contour, the second leading-edge-side contour, and the second trailing-edge-side contour.

12. The turbine blade according to claim 11, wherein the shank has the cross-section satisfying at least one of the condition (g) or (h) at a position, in a height direction of the shank, at which a distance between the first middle contour and the second middle contour is smallest.

13. A turbine comprising:

the turbine blade according to claim 11; and a rotor disc having a blade groove engaged with the blade root portion of the turbine blade.

* * * * *